US008292419B2

(12) United States Patent
Hori

(10) Patent No.: US 8,292,419 B2
(45) Date of Patent: Oct. 23, 2012

(54) INKJET RECORDING APPARATUS AND INKJET RECORDING METHOD

(75) Inventor: Hisamitsu Hori, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 497 days.

(21) Appl. No.: 12/472,473

(22) Filed: May 27, 2009

(65) Prior Publication Data

US 2009/0295894 A1 Dec. 3, 2009

(30) Foreign Application Priority Data

May 27, 2008 (JP) ..... 2008-138009

(51) Int. Cl.
*B41J 2/01* (2006.01)
*B41J 2/165* (2006.01)
*B41J 2/045* (2006.01)

(52) U.S. Cl. ..... 347/102; 347/30; 347/68

(58) Field of Classification Search ..... None
See application file for complete search history.

(56) References Cited

U.S. PATENT DOCUMENTS

| | | | | |
|---|---|---|---|---|
| 5,992,994 | A | 11/1999 | Rasmussen et al. | |
| 6,168,269 | B1 | 1/2001 | Rasmussen et al. | |
| 6,340,225 | B1 * | 1/2002 | Szlucha | 347/102 |
| 2001/0015746 | A1 | 8/2001 | Yosimura et al. | |
| 2004/0141041 | A1 * | 7/2004 | Tsutsumi et al. | 347/102 |
| 2004/0246325 | A1 * | 12/2004 | Sekiya | 347/104 |
| 2006/0203043 | A1 * | 9/2006 | Sanada | 347/70 |
| 2007/0019050 | A1 * | 1/2007 | Lim | 347/102 |

FOREIGN PATENT DOCUMENTS

| | | | |
|---|---|---|---|
| JP | 64-18669 A | | 1/1989 |
| JP | 8-258243 A | | 10/1996 |
| JP | 11-71042 A | | 3/1999 |
| JP | 11-91988 A | | 4/1999 |
| JP | 11-505190 A | | 5/1999 |
| JP | 2001-301151 A | | 10/2001 |
| JP | 2002-113853 A | | 4/2002 |
| JP | 2002-144528 A | | 5/2002 |
| JP | 2002144528 A | * | 5/2002 |
| JP | 2003-211749 A | | 7/2003 |
| JP | 2003-237018 A | | 8/2003 |

OTHER PUBLICATIONS

Japanese Office Action dated May 1, 2012 issued from the Japan Patent Office in connection with Japanese Patent Application No. 2008-138009 (English translation is attached).

* cited by examiner

*Primary Examiner* — Stephen Meier
*Assistant Examiner* — Alexander C Witkowski
(74) *Attorney, Agent, or Firm* — Birch, Stewart, Kolasch & Birch, LLP

(57) ABSTRACT

The inkjet recording apparatus includes: a conveyance device which conveys a recording medium; a drying air flow spraying device which sprays a drying air flow onto the recording medium while the recording medium is conveyed by the conveyance device; a negative pressure suctioning device which opposes the drying air flow spraying device, and suctions a rear surface of the recording medium and suctions at least a portion of the drying air flow sprayed by the drying air flow spraying device while the recording medium is conveyed by the conveyance device; and an inkjet head which ejects ink to be deposited on the recording medium.

23 Claims, 29 Drawing Sheets

INKJET RECORDING APPARATUS AND INKJET RECORDING METHOD

BACKGROUND OF THE INVENTION

1. Field of the Invention

The present invention relates to an inkjet recording apparatus and an inkjet recording method, and more particularly, to technology for promoting drying of liquid that has been deposited on a recording medium.

2. Description of the Related Art

Japanese Patent Application Publication No. 2003-237018 discloses a composition in which a heating device is provided in a chain conveyance section and/or a transfer drum (drying drum) in a sheet printing machine and a varnish coating is thereby dried.

Japanese Patent Application Publication No. 2002-144528 discloses a composition in which cut sheet printing paper is wrapped about and suctioned onto a drum (printing paper suction roller), in which state jets of heated air and cold air are sprayed to dry ink, the suctioning is released and pressure is applied, thereby separating the printing paper from the surface of the drum and outputting the paper.

Japanese Patent Application Publication No. 64-18669 discloses an inkjet printer in which conveyance errors, such as conveyance of multiple sheets, jamming, or the like, are reduced and furthermore ink is caused to permeate into paper thereby improving the fixing properties, by ejecting droplets of ink while suctioning and conveying paper on a drum. Furthermore, Japanese Patent Application Publication No. 64-18669 also discloses complementing the drying and fixing of the paper by spraying air suctioned from the suction conveyance drum, onto the paper after printing.

Japanese Patent Application Publication No. 8-258243 discloses technology for preventing excessive heating and excessive drying of the recording medium, by controlling the temperature of a circulated drying air flow by determining the conveyance speed and output temperature of the recording medium in a printing machine, such as an offset printing machine.

Japanese Patent Application Publication No. 2002-113853 discloses technology for improving laminate quality in an inkjet recording apparatus comprising a device for forming a laminate layer on the surface of a recorded object after the ejection of ink droplets, by stabilizing the drying of ink through controlling an ink drying device, an ink ejection device and the conveyance speed on the basis of the droplet ejection density, the ambient temperature and humidity, and the weight of the paper, from the standpoint of the protection and improvement of preservability of recording paper.

The composition disclosed in Japanese Patent Application Publication No. 2003-237018 performs drying while conveying the paper by means of a chain and a gripper provided on a pressure drum, and therefore stable paper conveyance with little incidence of conveyance errors, such as jamming, is possible. However; since the paper cannot be impelled against the surface of the pressure drum, or the like, then deformation, such as denting, curling or wrinkling, is liable to occur. Furthermore, there are possibilities that the sprayed heated air flow and the generated water vapor are liable to remain trapped inside the machine, and this can readily lead to internal soiling of the machine and increase in the internal temperature of the machine. Moreover, in drying on the transfer drum, effective use is not made of the transfer drums disposed on the upstream and downstream sides, and hence the apparatus is liable to increase in size and costs are liable to rise. Furthermore, unless the amount of drying is controlled appropriately, then it is difficult to achieve stable drying in respect of variations in the type of paper (coating layer, basis weight, and the like), the temperature and humidity, the liquid deposition volume, the drying temperature, and the like.

The composition disclosed in Japanese Patent Application Publication No. 2002-144528 can be expected to have a beneficial effect in suppressing wrinkling and curl since the paper is dried in a state of being suctioned to the drum, but if the paper is suctioned in a twisted state, for instance, a skewed state, then the problem of denting is liable to occur. Furthermore, even if the suction holes are composed which a dimension of approximately 0.5 mm which is the recommended value in Japanese Patent Application Publication No. 2002-144528, suction marks are liable to be left in the paper, if thin paper is used. Moreover, there are also problems in that the sprayed heated air flow and the generated water vapor are also liable to become trapped inside the machine, internal soiling of the machine and increase in the internal temperature of the machine are liable to arise, and furthermore, variations in drying are liable to occur in respect of changes in the type of paper, the temperature and humidity, the deposition liquid volume, the drying temperature, and so on, and therefore defects such as stickiness due to insufficient drying or cracking due to excessive drying are liable to occur.

Similarly to Japanese Patent Application Publication No. 2002-144528, the composition disclosed in Japanese Patent Application Publication No. 64-18669 is liable to leave suction marks in the paper if thin paper is conveyed by suctioning, and the sprayed air is also liable to become trapped inside the machine and give rise to internal soiling of the machine.

The composition disclosed in Japanese Patent Application Publication No. 8-258243 is able to prevent overheating of a prescribed level by controlling the temperature of the drying air flow on the basis of the conveyance speed and the output temperature, but it is difficult to achieve fine control for each respective sheet, since the response is slow. Furthermore, since air is recovered and circulated from the whole of the drying apparatus, then the heat capacity is large and warm-up takes a long time, and therefore the power consumption also tends to become large.

The composition disclosed in Japanese Patent Application Publication No. 2002-113853 reduces variation in ink drying by controlling a drying device on the basis of various information, but similarly to Japanese Patent Application Publication No. 8-258243, it is difficult to achieve fine control in respect of each sheet, since the response is slow.

SUMMARY OF THE INVENTION

The present invention has been contrived in view of these circumstances, an object thereof being to resolve the problems described above by providing an inkjet recording apparatus comprising a drying device whereby it is possible to suppress wrinkling or drying non-uniformities in the recording medium and variations in drying between papers, achieve compatibility with sheet-by-sheet control, reutilize heat and suppress soiling of the interior of the machine by water vapor, as well as providing an inkjet recording method using this drying technology.

In order to attain an object described above, one aspect of the present invention is directed to an inkjet recording apparatus, comprising: a conveyance device which conveys a recording medium; a drying air flow spraying device which sprays a drying air flow onto the recording medium while the recording medium is conveyed by the conveyance device; a negative pressure suctioning device which opposes the drying air flow spraying device, and suctions a rear surface of the recording medium and suctions at least a portion of the drying air flow sprayed by the drying air flow spraying device while the recording medium is conveyed by the conveyance device; and an inkjet head which ejects ink to be deposited on the recording medium.

In order to attain an object described above, another aspect of the present invention is directed to an inkjet recording method, comprising: a conveyance step of conveying a recording medium; a drying air flow spraying step of spraying a drying air flow onto the recording medium while the recording medium is conveyed in the conveyance step; a negative pressure suctioning step of suctioning a rear surface of the recording medium conveyed in the conveyance step while suctioning at least a portion of the drying air flow sprayed in the drying air flow spraying step; and an ink ejection step of ejecting ink to be deposited onto the recording medium, from an inkjet head.

According to the present invention, it is possible to stabilize drying by rapidly discharging the drying air flow sprayed onto the recording medium, and furthermore by adopting a composition which suctions and attracts the rear surface of the recording medium, it is possible to suppress deformation, such as wrinkling or curl.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein:

FIG. 10 is a perspective diagram illustrating a general view of the movement mechanism (abutment/separation mechanism) and rotational drive device of the spiral roller, the rotational mechanism of the squeegee blade and main blade, and so on;

DETAILED DESCRIPTION OF THE PREFERRED EMBODIMENTS

General Composition of Inkjet Recording Apparatus

Figure 1:
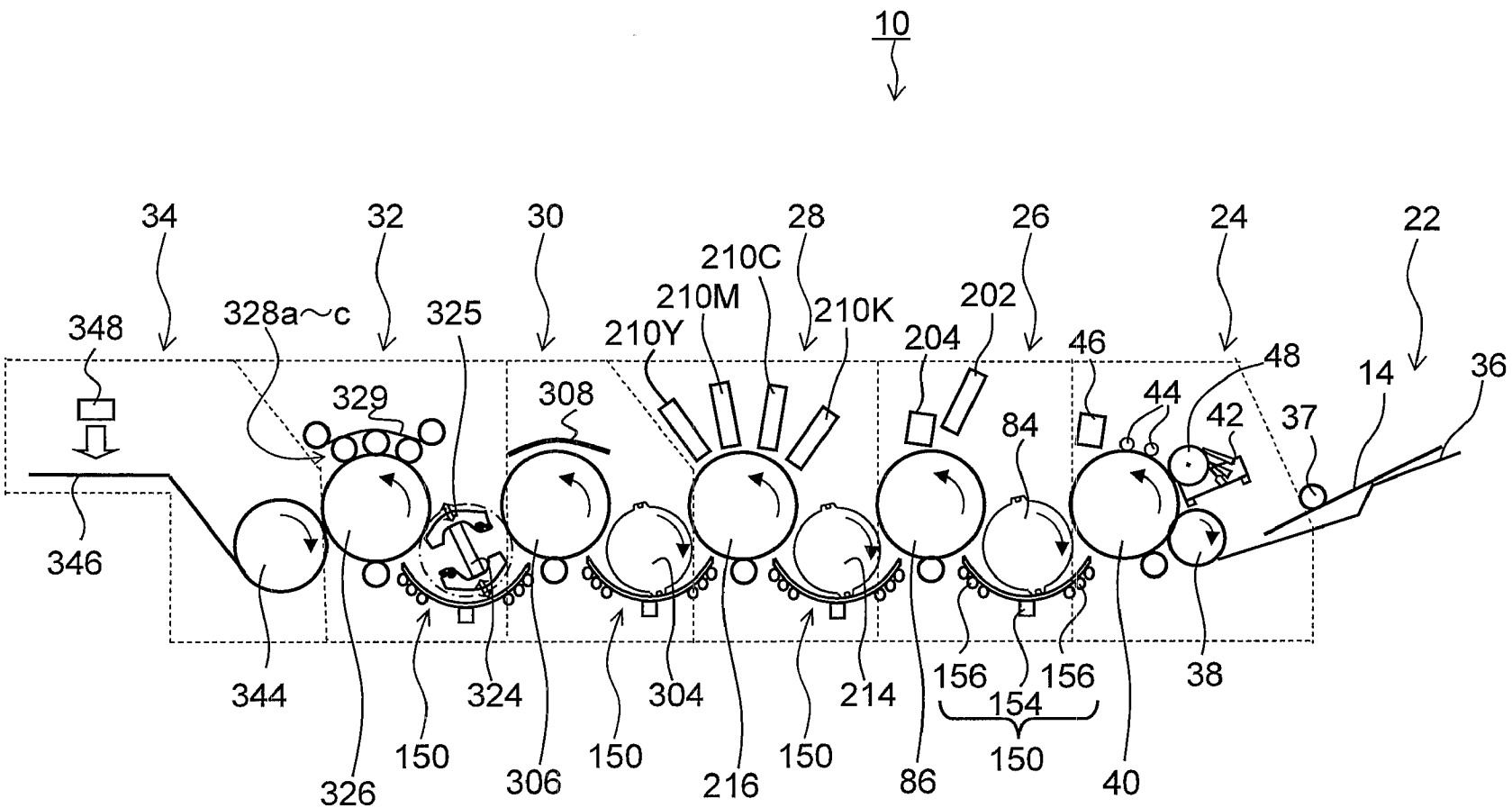
FIG. 1 is a general schematic drawing of an inkjet recording apparatus relating to an embodiment of the present invention.

FIG. 1 is a diagram of the general composition of an inkjet recording apparatus relating to an embodiment of the present invention. As illustrated in FIG. 1, the inkjet recording apparatus 10 according to the present embodiment is an inkjet recording apparatus using a pressure drum direct printing method employing a pressure drum, which is one mode of a direct printing method of forming an image directly on a recording medium 14.

The inkjet recording apparatus 10 principally comprises: a paper supply unit 22 which supplies a recording medium 14; a permeation suppression processing unit 24 which carries out permeation suppression processing on the recording medium 14; a treatment agent deposition unit 26 which deposits treatment agent, such as an ink aggregating agent, onto the recording medium 14; a print unit 28 which forms an image by depositing color inks onto the recording medium 14; a solvent drying unit 30 which dries the solvent of the color inks; a heat and pressure fixing section 32 which makes the image permanent; and an output unit 34 which conveys and outputs the recording medium 14 on which an image has been formed.

A paper supply tray 36 which supplies recording media 14 in the form of cut sheet is provided in the paper supply unit 22. A recording medium 14 which has been conveyed out from the paper supply tray 36 by an adhesive roller 37 is supplied via the transfer drum 38 to the circumferential surface of the pressure drum 40 of the permeation suppression processing unit 24 by the gripper (not illustrated).

The present apparatus uses an aggregating treatment agent with the object of achieving good image formation onto various media using an inkjet method. In particular, a method is employed in which an image is formed by ejecting, onto a recording medium on which an aggregating treatment agent having added luster stabilizing polymer particles (Lx) has been deposited and dried, droplets of ink having added polymer particles for fixing, and when the ink has aggregated, applying heat and thereby removing the water component, melting the polymer micro-particles and fixing same to the recording medium.

In this method, it is desirable that the drying of the aggregating treatment agent and the ink should be carried out uniformly and efficiently by taking account of the molten state of the added polymer particles and the drying temperature. In the related art devices proposed in Japanese Patent Application Publication No. 2003-237018, Japanese Patent Application Publication No. 2002-144528, Japanese Patent Application Publication No. 64-18669, Japanese Patent Application Publication No. 8-258243 and Japanese Patent Application Publication No. 2002-113853, it is difficult to achieve stability due to non-uniformities in the drying air flow and variations in the paper thickness, liquid deposition volume, and the like, and in a system which corrects drying by measuring the outlet temperature and the outlet water content of the drying unit, the response is liable to be slow and precise drying control on a sheet-by-sheet basis has been difficult to achieve. The inkjet recording apparatus 10 according to the present embodiment employs a drying device which resolves these problems.

Description of Permeation Suppression Processing Unit

In the permeation suppression processing unit 24, a liquid application apparatus 42, a paper pressing member 44 and a permeation suppression agent drying unit 46 are provided respectively at positions opposing the circumferential surface of the pressure drum 40, in this order from the upstream side in terms of the direction of rotation of the pressure drum 40 (the counter-clockwise direction in FIG. 1).

Figure 2:
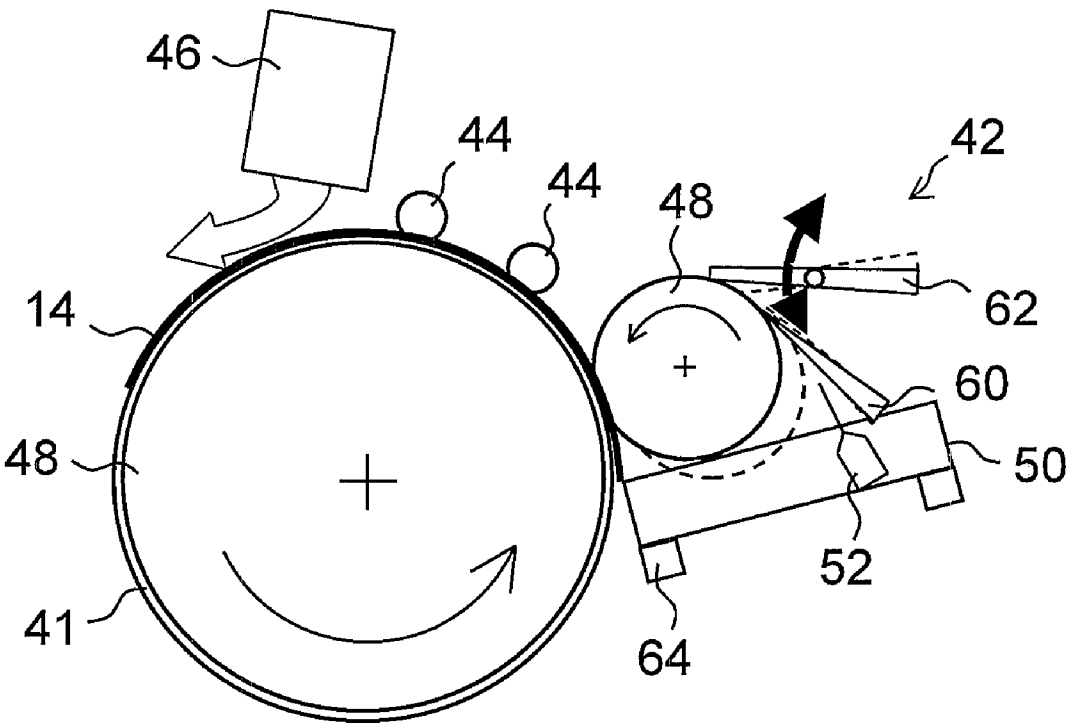
FIG. 2 is a compositional diagram illustrating a first example of a liquid application apparatus used in a permeation suppression agent application unit.

FIG. 2 is a schematic drawing of the permeation suppression processing unit 24. As illustrated in FIG. 2, the liquid application apparatus 42 is an apparatus which applies a permeation suppression agent selectively to a desired region of the recording medium 14 that moves in rotation while being held by a gripper (not illustrated) of a pressure drum 40, by abutting a spiral roller 48 having a spiral groove formed in the outer circumference by form rolling, or the like, against the rotating pressure drum 40, and driving the spiral roller 48 to rotate at a prescribed uniform speed in a direction opposite to the direction of rotation of the pressure drum 40 (the counter-clockwise direction in FIG. 2).

The circumferential surface of the pressure drum 40 is covered by an elastic layer 41, whereby positional deviation between the pressure drum 40 and the spiral roller 48 is alleviated and the wrapping of the recording medium 14 is stabilized. By using an elastic body having a hardness of 20 to 80° as the elastic layer 41 provided on the circumferential surface of the pressure drum 40, the contact of the spiral roller 48 is stabilized and uniform application is achieved. Furthermore, by using for the material of the elastic layer 41 provided on the circumferential surface of the pressure drum 40, any one of fluorine rubber, urethane rubber, silicone rubber, a fluorine elastomer, or a silicone elastomer, the surface tension (surface energy) can be set to 10 to 40 mN/m, liquid repelling properties can also be guaranteed, and hence the circumferential surface of the pressure drum 40 has excellent cleaning properties. This is also desirable since it improves the contact properties of the wrapped paper on the drum.

To give a specific example, it is possible to form the pressure drum 40 efficiently from cast iron, or the like, and then apply a lyophobic elastic layer 41 made of fluorine rubber, urethane rubber, silicone rubber or fluorine elastomer (Shin-Etsu Chemical Co., Ltd.: SIFEL 600 series, or the like) having a thickness of 0.1 to 1 mm to the surface of the drum. As the material of the elastic layer 41, it is possible to coat the surface of the rubber with PFA, or the like.

Figure 3:
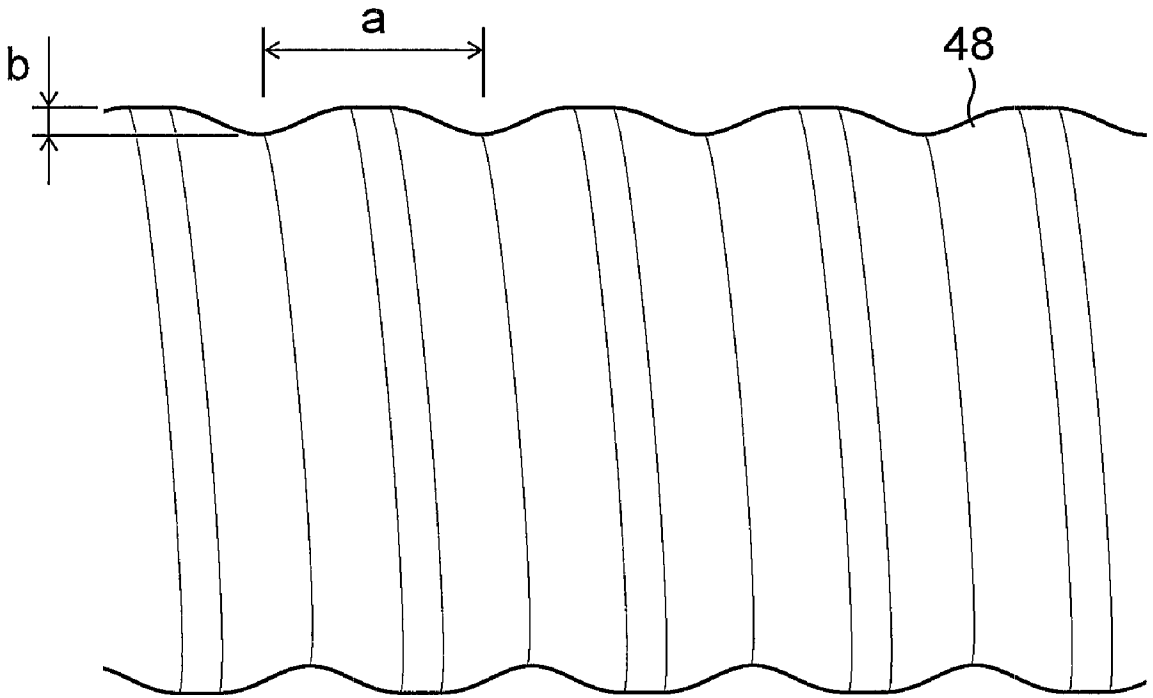
FIG. 3 is an enlarged diagram of the outer circumferential surface of a spiral roller.

FIG. 3 illustrates an enlarged diagram of the spiral roller 48. The spiral roller 48 is an application roller having grooves (depressions) formed on the outer circumferential surface thereof substantially following the direction of rotation, by form rolling using a die or by wrapping a wire about the roller, and the spiral roller 48 has a length (width direction) equal to or greater than the width dimension of the application receiving surface of the recording medium 14. The shape, pitch a and depth b of the grooves in the spiral roller 48 are selected appropriately in accordance with the amount of liquid that is to be applied (the thickness of the liquid film after application). For example, in the case of the liquid application apparatus 42 according to the present embodiment, a suitable spiral roller is one having a pitch a=0.08 to 0.2 mm, and a groove depth b=5 to 20 μm.

Figure 4A:
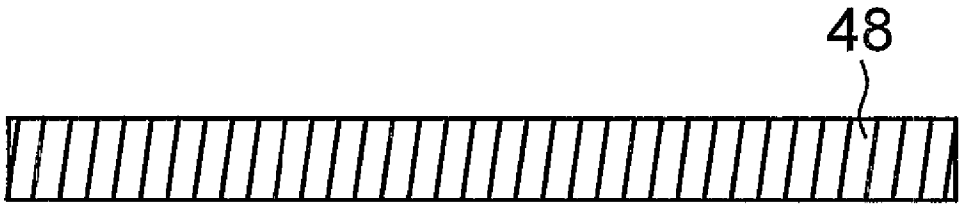
FIGS. 4A to 4C are general schematic drawings illustrating examples of the shape of grooves formed in the outer circumferential surface of the spiral roller.
Figure 4B:
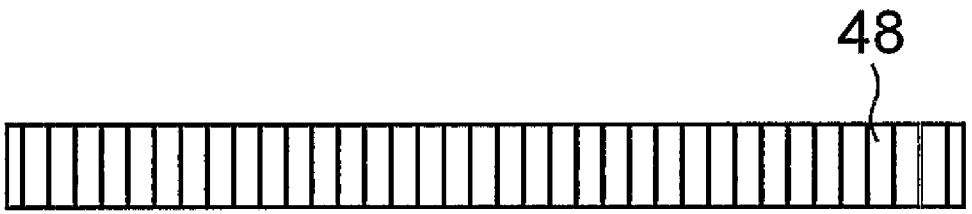
Figure 4C:
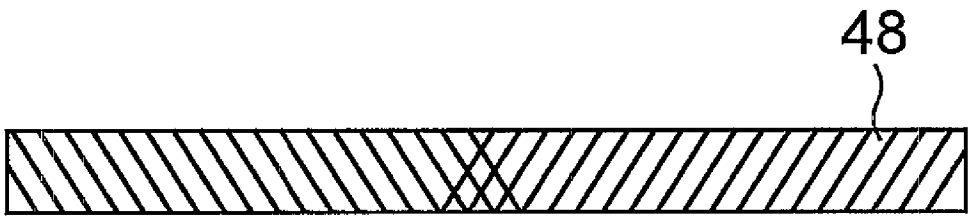
Figure 5A:
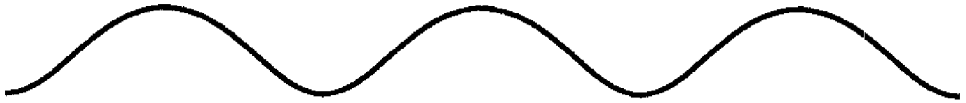
FIGS. 5A to 5D are general schematic drawings illustrating examples of the cross-sectional shape of the outer circumferential surface of the spiral roller.
Figure 5B:
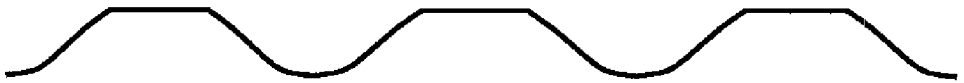
Figure 5C:
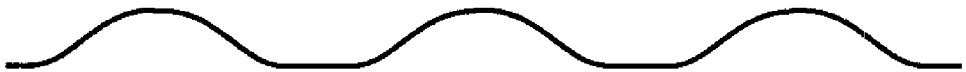
Figure 5D:
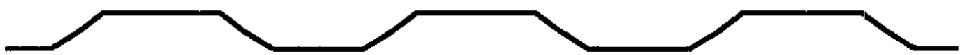

FIGS. 4A to 4C are schematic drawings illustrating the shape of the grooves of the spiral roller 48. In FIGS. 4A to 4C, in order to aid understanding of the shape of the grooves, the groove shape and the groove pitch, and the like, are depicted in a simplified fashion. As illustrated in FIGS. 4A to 4C, the groove shape may be, apart from a spiral shape as illustrated in FIG. 4A, an independent groove configuration (FIG. 4B), a left/right groove configuration (FIG. 4C), or a multi-column spiral configuration (not illustrated), or the like. In particular, if independent grooves are used, then it is possible to suppress flow of liquid in the breadthways direction of the application receiving medium, and furthermore, if left/right grooves are used, then it is possible to suppress wrinkling of the application receiving medium (recording medium 14). A conceivable modification of a left/right spiral configuration is an example where one spiral roller 48 is divided into a spiral roller having a leftward spiral shape formed in the outer circumferential surface and a spiral roller having a rightward spiral shape formed in the outer circumferential surface.

FIGS. 5A to 5D are schematic drawings illustrating the cross-sectional shape of the outer circumferential surface of the spiral roller 48. As illustrated in FIGS. 5A to 5D, possible examples of the cross-sectional shape of the outer circumferential surface are, apart from the S-shaped curved surface illustrated in FIG. 5A, a shape with flattened peaks (FIG. 5B), a shape with flattened troughs (FIG. 5C), or a shape which has flattened peaks and flattened troughs (FIG. 5D), or the like. In particular, if the peak sections are flattened, then the wear resistance properties are improved, and furthermore, if the trough sections are flattened, then a large amount of liquid enters into the grooves and hence a large amount of liquid can be made to adhere to the outer circumferential surface of the roller.

As a device for depositing permeation suppression agent (first liquid) onto the spiral roller 48 having this composition, the liquid application apparatus 42 illustrated in FIG. 2 comprises a liquid spraying unit 52 inside a container 50 (see FIG. 2). A single-fluid flat spray nozzle in which the spray angle can be controlled, or a pressurized two-fluid flat spray nozzle, is used as the spraying member of the treatment liquid spraying unit 52. More specifically, the nozzle used is, for example, a single-fluid flat spray nozzle having an orifice diameter of approximately 0.2 mm to 0.4 mm and a spray angle of 60° to 100°, or a pressurized two-fluid flat spray nozzle of similar size.

As illustrated in FIG. 2, the liquid spraying unit 52 sprays permeation suppression agent toward the vicinity of the front end of a squeegee blade 60 from below the spiral roller 48. In this way, the spraying pressure is controlled in such a manner that the spraying angle is set so as to achieve an application width which matches the width of the image forming region. In other words, the liquid spraying unit 52 forms a supply width control device which controls the width over which the permeation suppression agent is supplied on the outer circumferential surface of the spiral roller 48.

Figure 6:
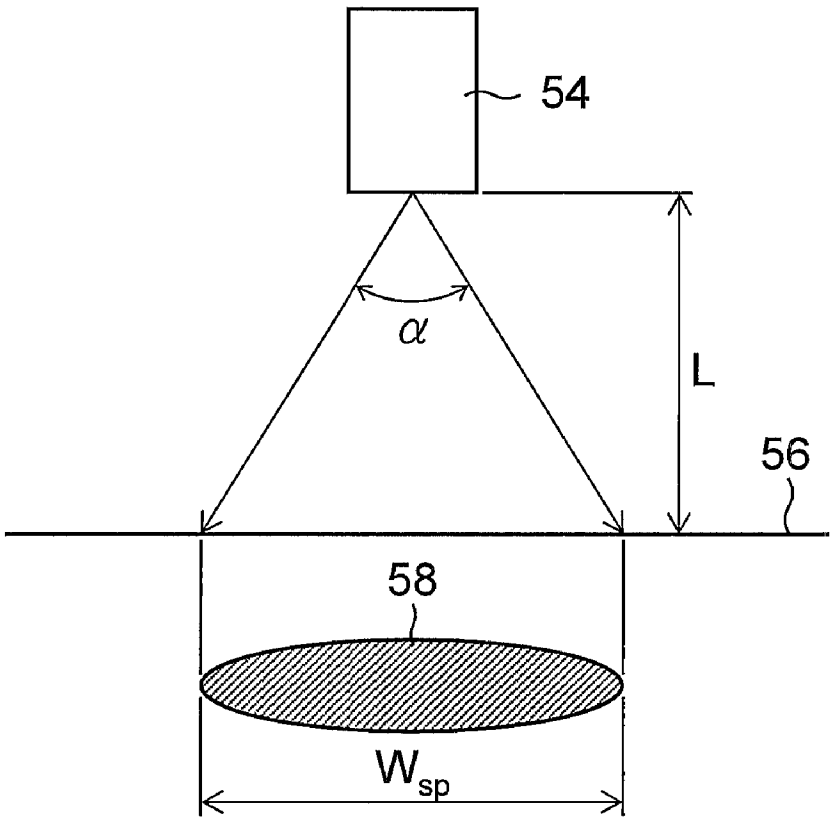
FIG. 6 is an illustrative diagram of a flat spray nozzle.

As illustrated in FIG. 6, since the flat spray nozzle sprays fluid at a spray angle of $\alpha$, then the effective spray width $W_{sp}$ of the spray range 58 is governed by the distance L between the ejection surface of the nozzle body 54 of the liquid spraying unit 52 and the spray receiving surface 56. The flat spray nozzle is not limited to a mode where a single nozzle is used, and it is also possible to use a plurality of flat spray nozzles aligned in the breadthways direction of the spiral roller 48. In this case, it is possible to control the removal process in the breadthways direction, as well as the conveyance direction.

Figure 7:
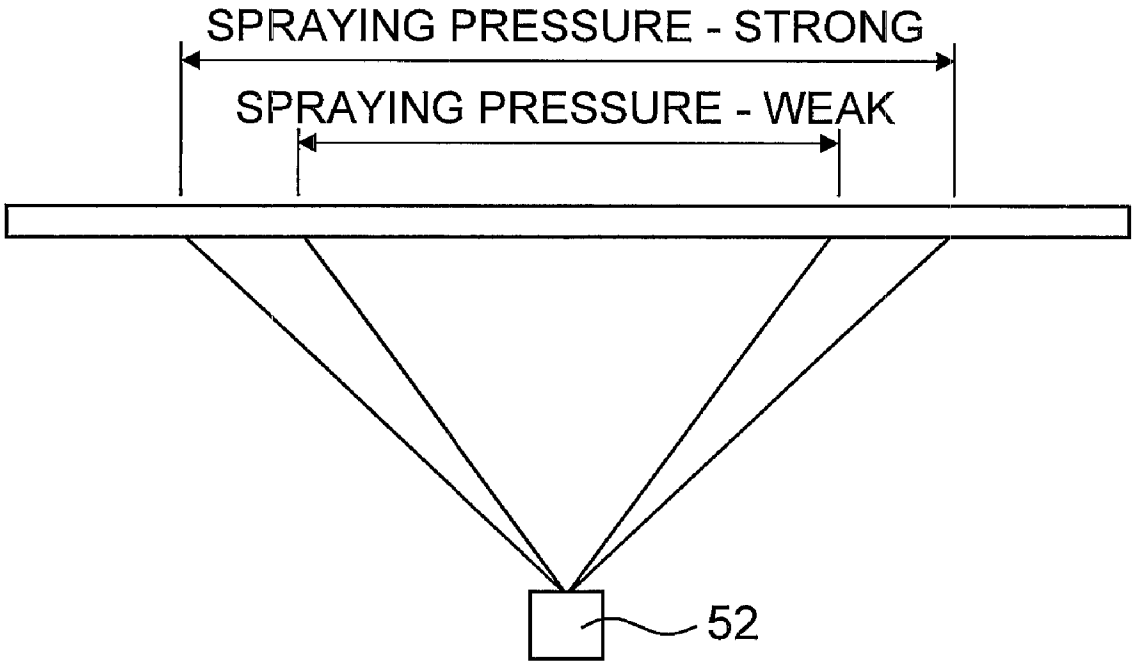
FIG. 7 is a schematic drawing illustrating the relationship between a liquid spraying unit and the spraying width.

FIG. 7 is an explanatory diagram illustrating a schematic view of the relationship between the spray pressure and the spray width of the liquid spraying unit 52. As illustrated in FIG. 7, the nozzle of the liquid spraying unit 52 can be switched between at least two different spray widths (spraying ranges in the breadthways direction). FIG. 7 illustrates an example in which two spray widths are achieved on the basis of the strength of the spraying pressure, but it is also possible to adopt a mode in which three or more spray widths are achieved, in accordance with different sizes of the recording media 14 and/or differences in the image forming range. Information relating to the recording medium 14 may be acquired automatically by means of a sensor, or the like, or it may be acquired by being input by the operator.

Figure 8:
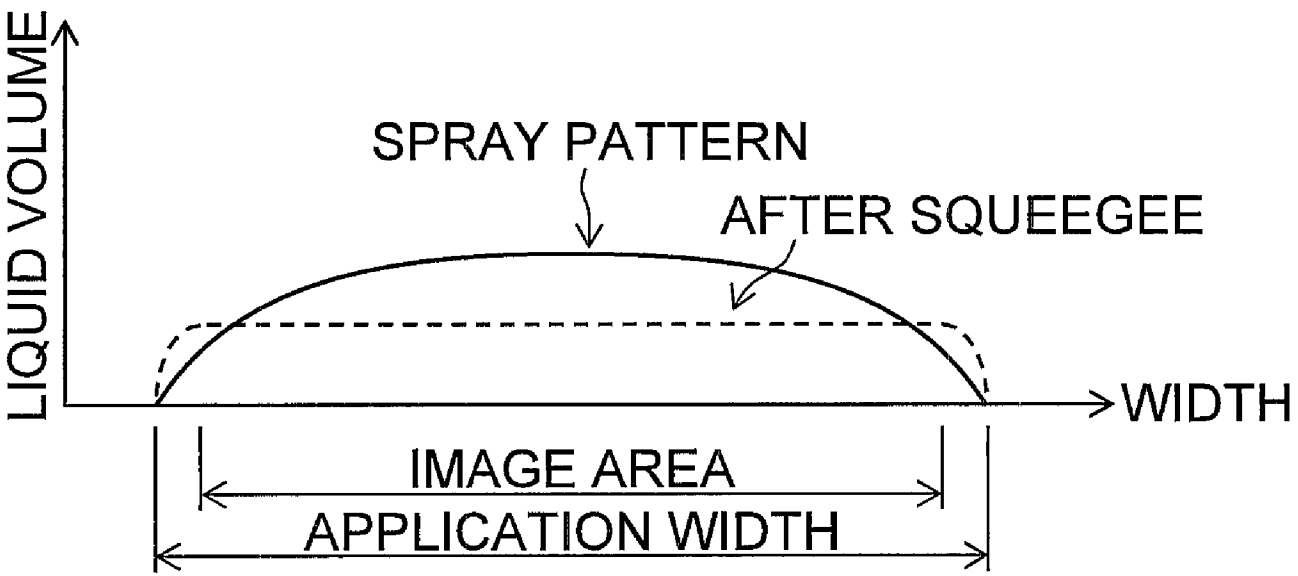
FIG. 8 is a graph illustrating the liquid volume distribution of a liquid spraying pattern achieved by a flat spray.

As illustrated in FIG. 8, the liquid spray pattern achieved by the flat spray creates a liquid amount distribution in the breadthways direction. Furthermore, the spray amount (flow rate) varies depending on the spraying pressure. However, in the case of the present example, since excess liquid is removed by the squeegee blade 60, in such a manner that the liquid can be applied in a range which is broader than the width of the effective image area, then it is possible to keep the amount of liquid deposited onto the spiral roller 48 to a stable amount, and it is therefore possible to achieve uniform application with a controlled application width.

In the present embodiment, a spiral roller 48 which is formed with spiral-shaped grooves is used, and therefore it is possible to reduce spilling of the permeation suppression agent in the breadthways direction by means of the projection-recess shape of the grooves. Therefore, width control is further improved, and due to the smoothing effects of the coated paper, the contact friction can be reduced even in portions in the width direction where liquid is not applied.

By spraying a permeation suppression agent from the liquid spraying unit 52 onto a portion of the spiral roller 48 (the lower side portion in FIG. 2), the permeation suppression agent enters into the grooves in the spiral roller 48, and the permeation suppression agent becomes attached to the outer circumferential surface of the roller (application liquid supply step).

As illustrated in FIG. 2, a squeegee blade 60 which is a squeegee member forming a device for wiping off excess liquid from the outer circumferential surface of the spiral roller 48 is provided in an erect fashion inside the container 50. Here, the "excess liquid" means the portion of the liquid applied to the outer circumferential surface of the spiral roller 48 which is applied outside the grooves formed in the spiral roller 48. The front end portion of the squeegee blade 60 is disposed so as to contact the spiral roller 48, and this front end portion is impelled in a direction which presses against the circumferential surface of the spiral roller 48. This impelling force may be caused by the elastic deformation of the squeegee blade 60 itself, or it may be applied from an external source by using a spring or other impelling member (not illustrated).

By wiping away excess permeation suppression agent by means of the squeegee blade 60 while rotating the spiral roller 48 on which permeation suppression agent has been deposited in this way, only the liquid held in the grooves avoids the squeegee blade 60 (squeegee step).

Furthermore, in the present embodiment, from the viewpoint of controlling the range of application of the permeation suppression agent in the direction of conveyance of the recording medium 14 (hereinafter, also called "medium conveyance direction"), in the liquid application apparatus 42, a main blade 62 forming a blade member is disposed on the downstream side of the squeegee blade 60 in terms of the direction of rotation of the spiral roller 48, and is controlled so as to abut against and separate from the outer circumferential surface of the spiral roller 48.

By abutting the main blade 62 against a partial range of the outer circumferential surface of the spiral roller 48, it is possible to remove liquid that has been applied to the outer circumferential surface including the permeation suppression agent inside the grooves of the spiral roller 48 (blade abutting step).

By controlling the range in which the liquid is removed from the spiral roller 48 by the main blade 62, it is possible to control the range of application of the permeation suppression agent to the recording medium 14 (the region in the medium conveyance direction) (blade abutting and separation control step).

More specifically, the main blade 62 is abutted against the outer circumferential surface of the spiral roller 48 in the region corresponding to the non-image forming portion on the recording medium 14, and the main blade 62 is separated from the outer circumferential surface of the spiral roller 48 in the region corresponding to the image forming portion on the recording medium 14. In this way, treatment liquid is not applied to the non-image forming portion on the recording medium 14, and it is possible to apply treatment liquid selectively, to the image forming portion only (see (a) of FIG. 9).

Figure 9:
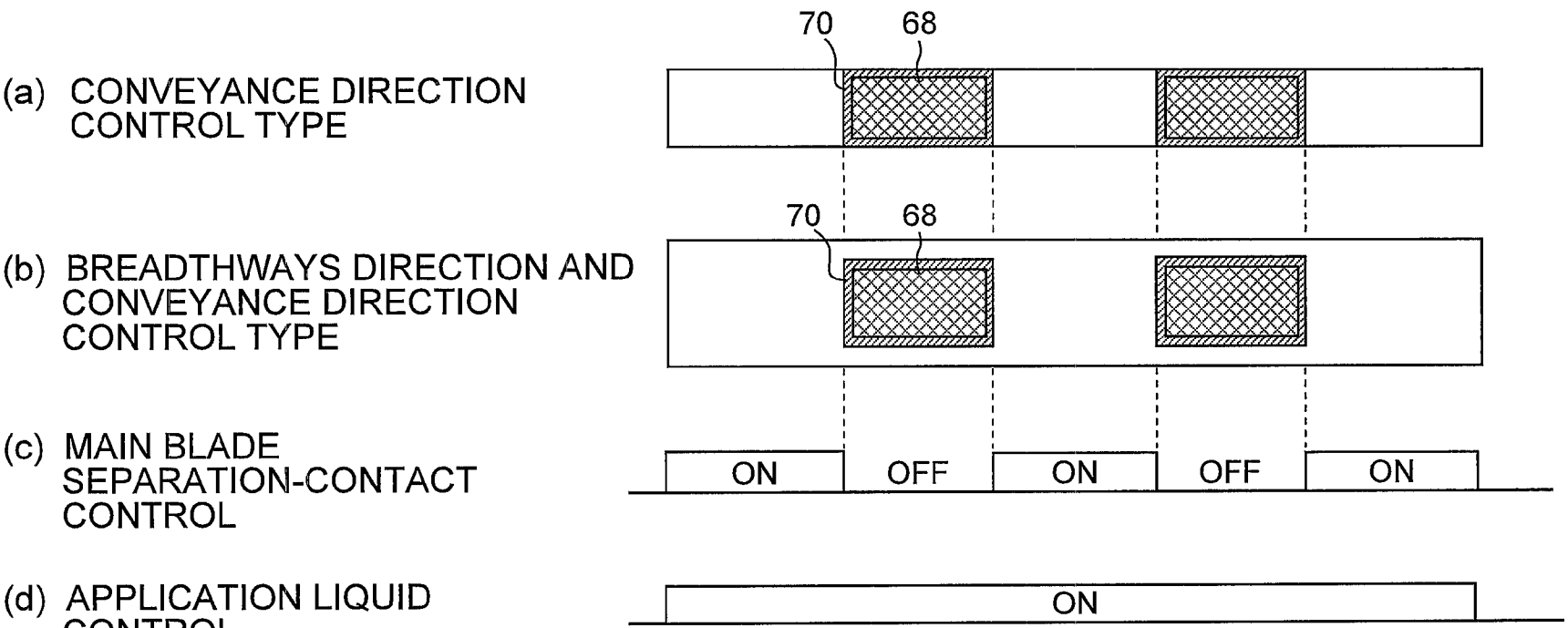
FIG. 9 is an illustrative diagram illustrating an example of the control of the application range.

(a) of FIG. 9 illustrates a case where the range of application (application surface area) is controlled in the direction of conveyance of the recording medium 14. (b) of FIG. 9 illustrates a case where the range of application is controlled in the breadthways direction and the direction of conveyance of the recording medium 14.

The recording medium 14 has a width that is greater than the range of the effective image portion 68 where an image is formed, and permeation suppression agent is applied to a region greater than the effective image portion 68 (namely, to the application portion indicated by reference numeral 70).

(c) of FIG. 9 represents the timing of the control of separation and abutment of the main blade 62. (d) of FIG. 9 represents the control of deposition of application liquid (treatment liquid) onto the spiral roller 48.

As illustrated in (d) of FIG. 9, the application liquid is deposited uniformly and continuously on the spiral roller 48 itself, and the application range is controlled in the conveyance direction by controlling the separation and abutment of the main blade 62 as illustrated in (c) of FIG. 9 (see (a) and (b) of FIG. 9).

Furthermore, the spraying pressure of the liquid spraying unit 152 is controlled and the application range in the breadthways direction is changed, in accordance with variation in the size of the recording medium 14.

According to this mode, it is possible to control application of the permeation suppression agent onto unwanted regions, and even when paper is supplied in a non-continuous fashion, for instance, in the form of cut paper, it is possible to prevent adherence of the permeation suppression agent to the pressure drum 40. Consequently, the operation of the apparatus is stabilized, and the reliability over time in terms of soiling and corrosion is improved. As illustrated in FIG. 2, a liquid discharge port 64 is formed in the bottom part of the container 50, and this liquid discharge port 64 is connected to a recovery tank via a discharge valve (not illustrated). The recovered liquid can be reused as liquid for application.

Figure 10:
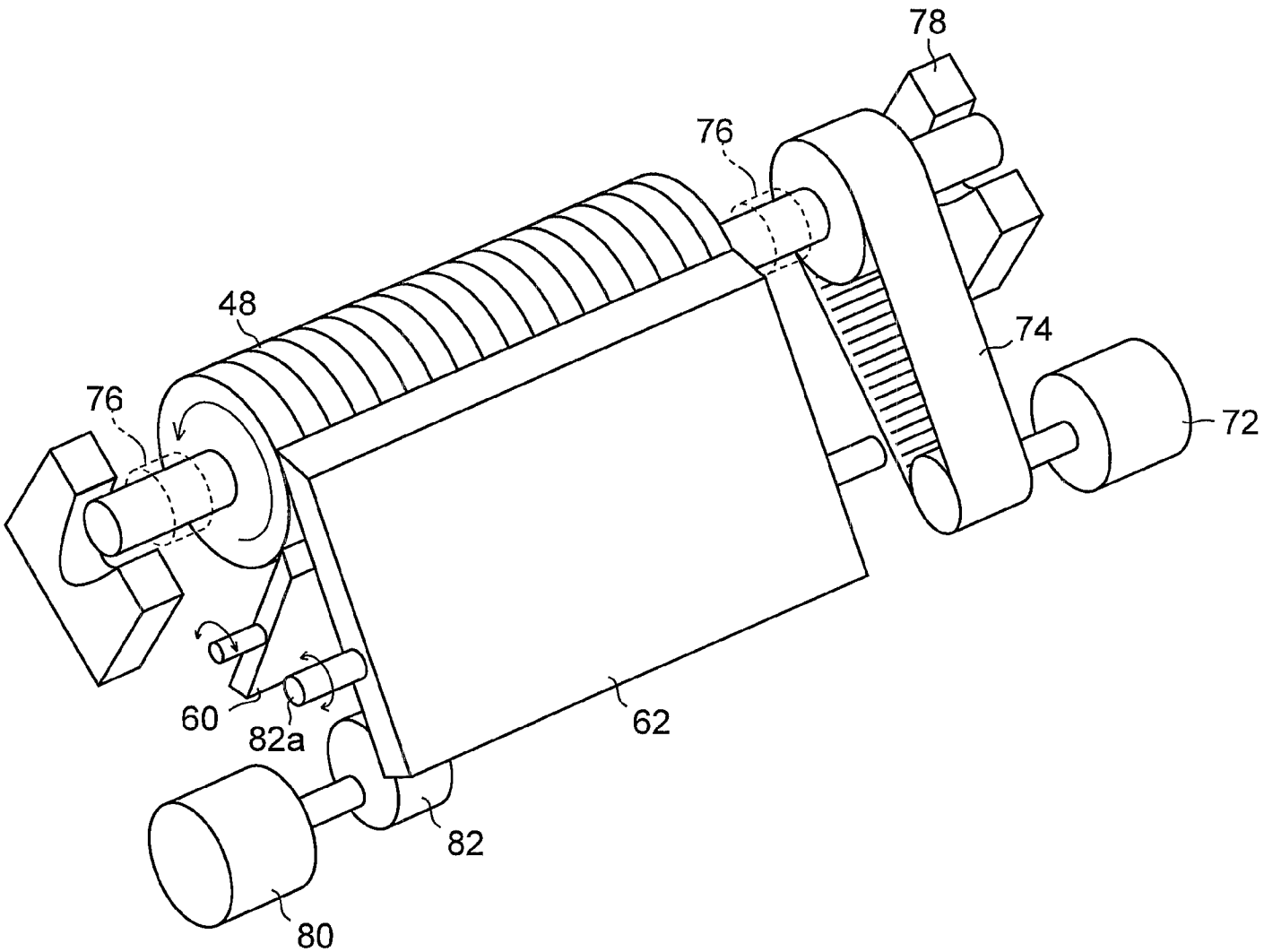

FIG. 10 is a perspective diagram illustrating an approximate view of a movement mechanism (abutment/separation mechanism) and a rotational drive device of the spiral roller 48 which constitutes the liquid application apparatus 42, and the rotational mechanisms of the squeegee blade 60 and main blade 62, and the like.

As illustrated in FIG. 10, one example of a rotational drive device of the spiral roller 48 is a mode which combines a motor 72 and a wrapped drive transmission device, including a timing belt 74, and the like. However, the composition is not limited to this, and it is also possible to use direct drive by an inverter motor (coupled axle), or a combination of motors of various types and a reducing gear device, or the like. Axle bearings 76 are provided on the rotating axle of the spiral roller 48.

The spiral roller 48 is supported movably in the vertical direction in FIG. 2 by means of a movement mechanism (abutment/separation mechanism), such as a push latch 78, and the like. Consequently, it is possible to implement control for switching between a state where the spiral roller 48 is pushed against the pressure drum 40 (the abutted (nipped) state in FIG. 2), and a state where the spiral roller is separated (withdrawn) from the recording medium 14.

As illustrated in FIG. 10, the main blade 62 is able to rotate about the rotating axle 82*a* by causing an eccentric cam 82 to rotate by means of a cam motor 80. By this means, it is possible to control switching between a state of abutment against the spiral roller 48, and a state of separation from the spiral roller 48.

Furthermore, as indicated by the dotted line in FIG. 2, it is also possible to increase the impelling force of the main blade 62 and to separate the spiral roller 48 from the pressure drum 40. By this means, it is possible to avoid friction between the spiral roller 48 and the application receiving medium when application is not being carried out during standby, or when liquid cleaning is halted, and furthermore, it is also possible to avoid contact between the spiral roller 48 and the stepped portion of the gripper (not illustrated) which is provided in the pressure drum 40. The reliability of the apparatus is further improved if the spiral roller 48 is separated from the pressure drum 40 and fixed and supported by the push latch 78 (see FIG. 10).

According to the liquid application apparatus 42 having the composition described above, the treatment liquid deposition width in the breadthways direction is controlled by the liquid spraying unit 52, and the liquid deposition range in the paper conveyance direction (the circumferential direction on the spiral roller 48) is controlled by the main blade 62.

Figure 11:
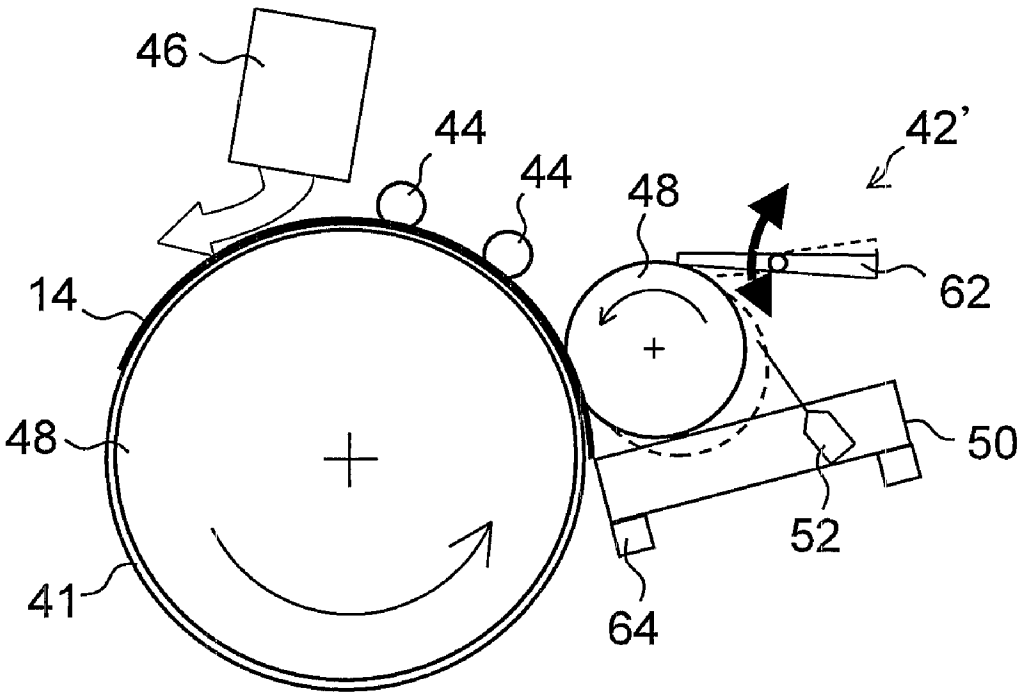
FIG. 11 is a compositional diagram illustrating a second example of the liquid application apparatus.

Furthermore, instead of the mode illustrated in FIG. 2, it is also possible to adopt the mode of the liquid application apparatus 42' in which, as illustrated in FIG. 11, the impelling force of the main blade 62 can be switched, the squeegee blade 60 is not used, and application is controlled by means of the main blade 62 only (a single blade only).

Apart from this, although not illustrated in the drawings, it is also possible to omit the liquid spraying unit 52 and to apply permeation suppression agent to the outer circumferential surface of the spiral roller 48 by immersing the spiral roller 48 in permeation suppression agent that has been introduced into the container 50.

Furthermore, if using a recording medium 14 having a coating layer on the surface thereof or a recording medium 14 on which a liquid containing a smoothing component has been deposited, it is possible to reduce contact friction between the spiral roller 48 and the recording medium 14 in the non-application portion, and therefore application of greater stability and higher reliability can be achieved.

As the permeation suppression agent used in the present embodiment, it is desirable to use a latex solution in which polymer particles of LX-1 or LX-2, or the like, indicated in Table 1 below, are added to water or a solvent. An example of the preparation of the liquid is indicated in the item of "<Preparation of liquids>(1) Preparation of permeation suppression agent" below.

TABLE 1

| Category | Composition | Particle size (diameter: μm) | Tg (° C.) | MFT (° C.) | Tm (° C.) |
|---|---|---|---|---|---|
| Aggregating treatment agent (LX-1) | Low-molecular-weight ethylene | 4 | — | — | 110 |
| | Low-molecular-weight ethylene | 1 | — | — | 110 |
| | Paraffin wax | 0.3 | — | — | 66 |
| Ink (LX-2) | Acrylic | 0.12 | 65 | 47 | — |
| | Styrene acrylic | 0.07 | 49 | 46 | — |

Tg: glass transition point
Tm: melting point

Of course, the permeation suppression agent is not limited to being a latex solution, and for example, it is also possible to use flat sheet-shaped particles (mica, or the like), or a hydrophobic agent (a fluorine coating agent), or the like.

The paper pressing member 44 (see FIG. 2 and FIG. 11) which is disposed to the downstream side of the liquid application apparatus 42 (42') that applies permeation suppression agent is a roller for feeding the recording medium 14 in the direction of rotation of the pressure drum 40, while pressing on either both ends or the trailing end of the recording medium 14 which has been supplied to the circumferential surface of the pressure drum 40.

A heater of which the temperature is adjustable in the range of 50° C. to 130° C., and a fan for blowing an air flow in the downstream direction at a rate of 5 to 50 m/s are provided in the permeation suppression agent drying unit 46. When the recording medium 14 held on the pressure drum 40, which is an application drum, passes downstream from a position opposing the permeation suppression agent drying unit 46, a heated air flow heated to 50° C. to 130° C. by means of a heater is directed by a fan onto the recording medium 14, thereby heating the recording medium 14, and the permeation suppression agent is pre-dried.

The treatment liquid deposition unit 26 is provided after the permeation suppression processing unit 24. A transfer drum 84 is provided between the pressure drum 40 of the permeation suppression processing unit 24 and the pressure drum 86 of the treatment liquid deposition unit 26 so as to lie in contact with both of these drums. By this means, after carrying out permeation suppression processing and pre-drying, the recording medium 14 held on the pressure drum 40 of the permeation suppression processing unit 24 is transferred to the pressure drum 86 of the treatment liquid deposition unit 26 via the transfer drum 84, by means of a gripper (not illustrated in FIG. 1, indicated by reference numeral 91 or 92 in FIG. 12).

Structure of Transfer Drum

Here, an example of the structure of the transfer drum 84 will be described.

Figure 12:
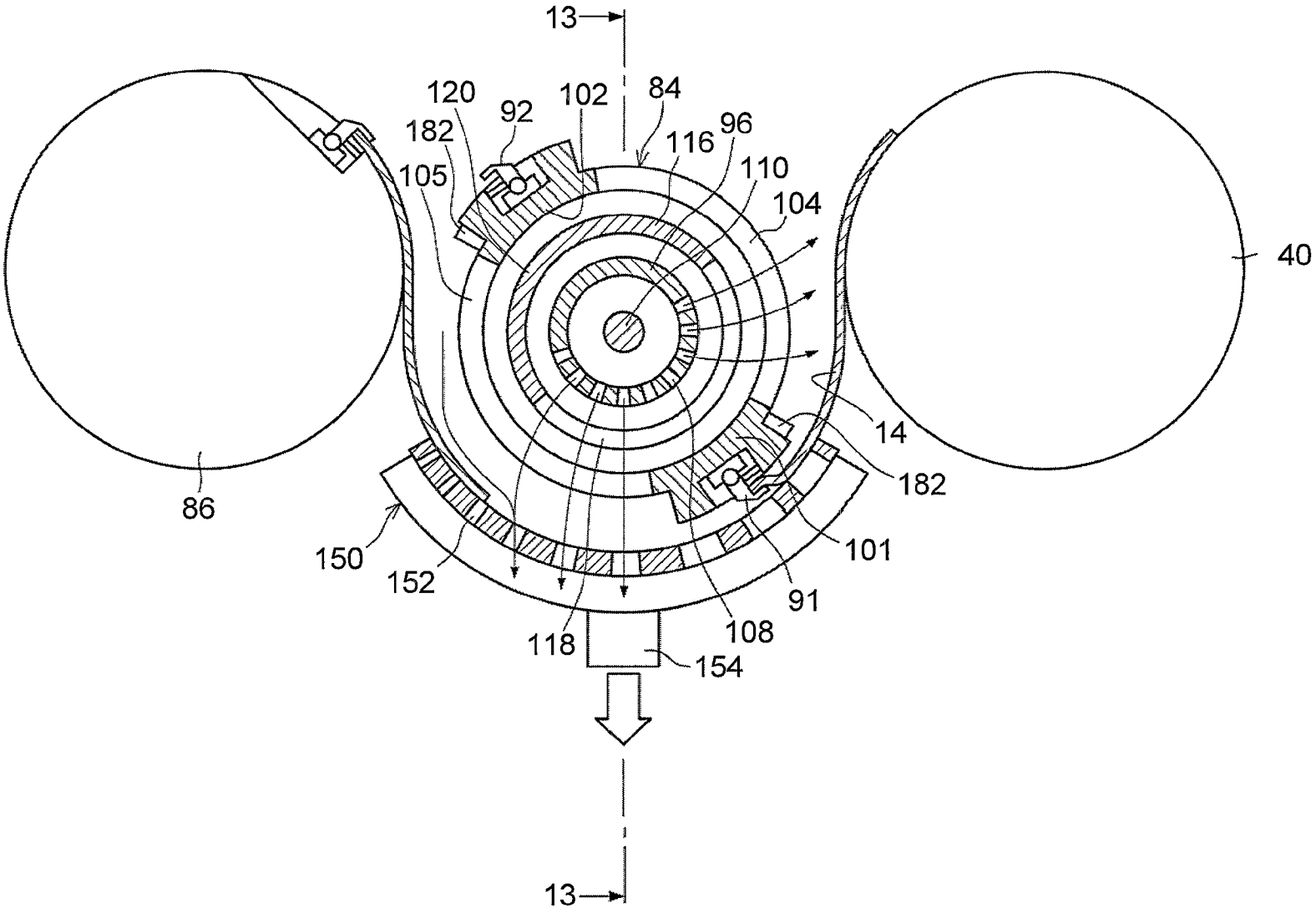
FIG. 12 is a cross-sectional diagram illustrating the structure of a first example of a transfer drum.
Figure 13:
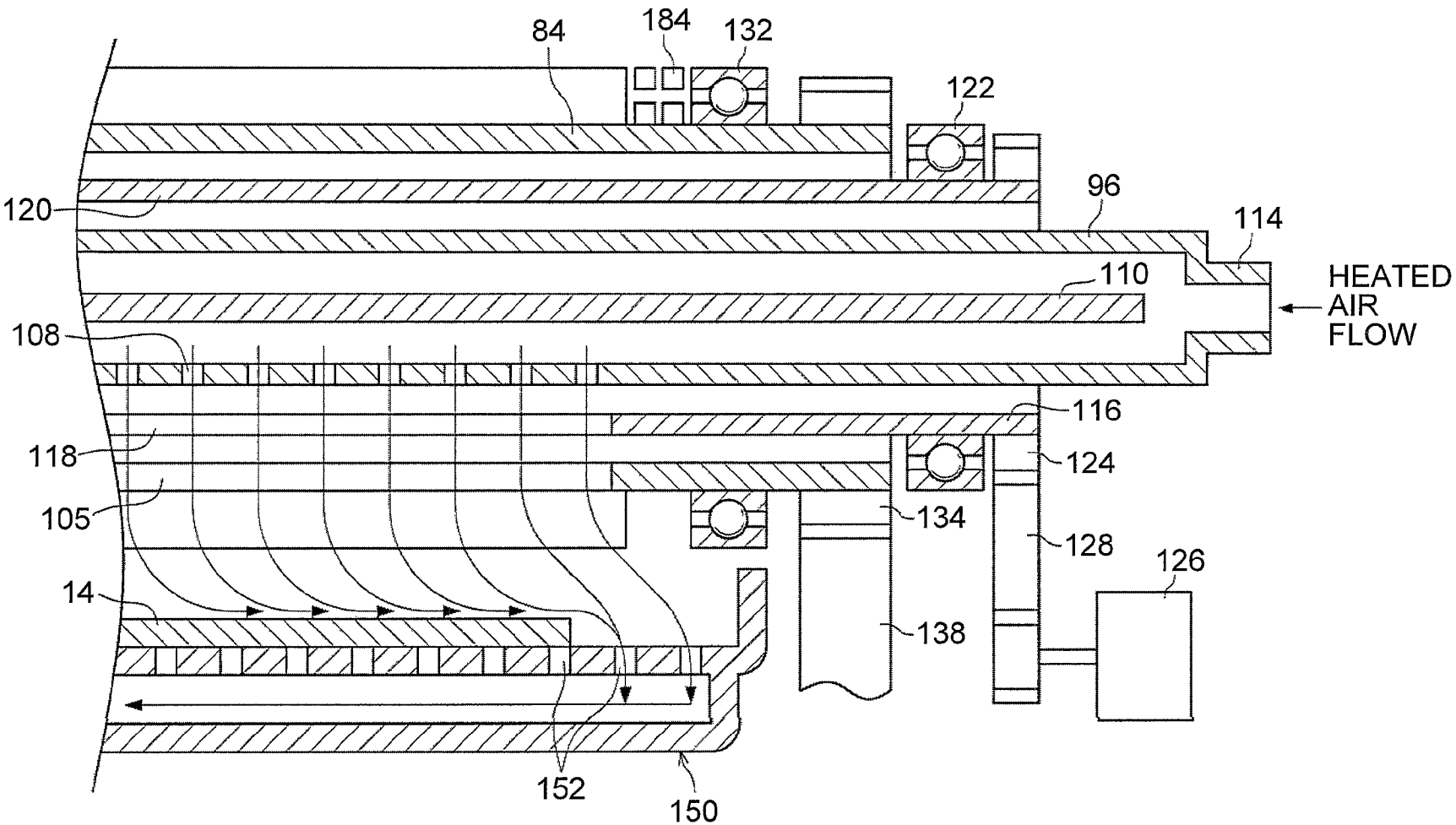
FIG. 13 is a cross-sectional diagram along line 13-13 in FIG. 12.

FIG. 12 is a cross-sectional diagram illustrating details of an example of the structure of the transfer drum 84 (first example), and FIG. 13 is a cross-sectional diagram along line 13-13 in FIG. 12 (a sectional diagram based on a cross-sectional plane which includes the central axis of the transfer drum 84).

As illustrated in these drawings, grippers 91 and 92 for gripping and thereby holding and conveying the recording medium 14 (hereinafter, also called "paper") are disposed at two symmetrical positions on the outer circumferential portion of the transfer drum 84. A heated air flow spraying member 96 for spraying a heated air flow for drying onto the recording medium 14 is fixed inside the transfer drum 84 which is provided with the grippers 91 and 92. Furthermore, opening sections 104 and 105 through which this heated air flow passes are formed on the region of the circumferential surface of the transfer drum 84 apart from the two gripper support sections 101 and 102 on the transfer drum 84.

The heated air flow spraying member 96 has a round tubular shape which is coaxial with the transfer drum 84, and a plurality of holes 108 forming heated air blowing ports are formed in a partial region of the circumferential surface thereof (the lower side region of the circumferential surface in FIG. 12).

A heater 110 forming a heating device is provided inside the heated air flow spraying member 96. The heater 110 is disposed so as to extend following the axis of the transfer drum 84 in the central portion of the transfer drum 84. For the heater 110, it is possible to use a halogen heater or an infrared heater, for example. A heated air flow is introduced by the heated air blowing device (not illustrated in FIG. 12; see FIG. 14) from the axial direction of the heated air flow spraying member 96, and the temperature thereof is adjusted by the heater 110 and is blown out from the blowing ports (holes 108) of the heated air flow spraying member 96 (see FIG. 13).

In other words, as illustrated in FIG. 13, a heated air supply port 114 for connecting the air blowing device (not illustrated in FIG. 13, see FIG. 14) which is a heated air flow generating device is formed in the end portion of the heated air flow spraying member 96 in the axial direction (the right-hand end portion in FIG. 13). Heated air is introduced into the heated air flow spraying member 96 via the heated air supply port 114, and this heated air is further heated by the heater 110 to adjust the temperature thereof and is then expelled outwards from the blowing ports (holes 108) of the heated air flow spraying member 96.

Moreover, a spray restricting member 116 which restricts the range, in the paper conveyance direction, of the spray of heated air blown onto the recording medium 14 is provided to the inside of the transfer drum 84 and to the outside of the heated air flow spraying member 96 (see FIG. 12). The spray restricting member 116 is a member provided independently of the transfer drum 84, which has a round tubular shape that is coaxial with the transfer drum 84, and is provided rotatably about an axle. A passage opening 118 through which heated air from the heated air flow spraying member 96 can pass, and a shielding portion 120 which shuts off the passage of heated air, are formed in the circumferential surface of the spray restricting member 116.

By controlling the rotation of the spray restricting member 116, the position of the passage opening 118 of the spray restricting member 116 is moved relatively with respect to the region of the heated air flow spraying member 96 where the blowing ports (holes 108) are formed and the opening sections 104 and 105 of the transfer drum 84, and hence the spraying range of the heated air flow in respect of the paper conveyance direction can be made larger or smaller in size.

The reference numeral 122 in FIG. 13 is an axle bearing which supports the spray restricting member 116 rotatably. As a device for driving the spray restricting member 116 so as to rotate, a gear 124 is formed on a suitable position of the circumferential surface of the spray restricting member 116 (in the present embodiment, the circumferential surface of the end portion of the spray restricting member 116) and a spray restricting member drive motor 126 and a drive gear 128 which transmits the drive force of this motor to the gear 124 are provided.

Similarly, the transfer drum 84 is supported rotatably by means of axle bearings 132, and as a device for driving the transfer drum 84 so as to rotate, a gear 134 is formed in the circumferential surface of the transfer drum 84, and a transfer drum drive gear 138 which enmeshes with the gear 134 and a motor (not illustrated) are also provided. The drive transmission device is not limited to a geared transmission mechanism, and may also employ a belt transmission mechanism, or the like.

A conveyance guide 150 (which corresponds to a "negative pressure suctioning device") is provided in a position opposing the transfer drum 84 having the composition described above, and a plurality of apertures (suction holes 151) for suctioning the recording medium 14 with negative pressure are provided in the conveyance guide 150 following the breadthways direction and the conveyance direction (see FIG. 12). This conveyance guide 150 is fixed to a prescribed position which composes the conveyance path of the recording medium 14, and a negative pressure suctioning pump (not illustrated in the drawings and indicated by reference numeral 155 in FIG. 28) is connected to a suctioning connection port 154 of the conveyance guide 150.

Furthermore, a heating device 156 of an electromagnetic induction type is provided in the conveyance guide 150 (see FIG. 1), and the recording medium 14 which is conveyed in contact with the conveyance guide 150 is thereby adjusted to a temperature of 50° C. to 90° C.

The surface of the recording medium 14 that has been transferred to the transfer drum 84 by the grippers 91 and 92 is heated and dried by a heated air flow sprayed from the transfer drum 84 while being suctioned by negative pressure to the conveyance guide 150. In this, since sheets of the recording medium 14 (paper) are conveyed at an interval apart, the sprayed heated air flow is suctioned by negative pressure through the apertures 151 of the conveyance guide 150, from the gap between the trailing end of the paper and the leading end of the paper to be conveyed subsequently. Therefore, even when the paper is heated and dried, problems such as wrinkling and denting are not liable to occur and the marks of the suction holes are not liable to be left, thus making it possible to prevent contamination by water vapor inside the apparatus.

Moreover, by returning the heated air flow suctioned from the conveyance guide 150 to the spraying unit and using same for heat exchange in the heated air flow generating device, then thermal efficiency is improved.

Figure 14:
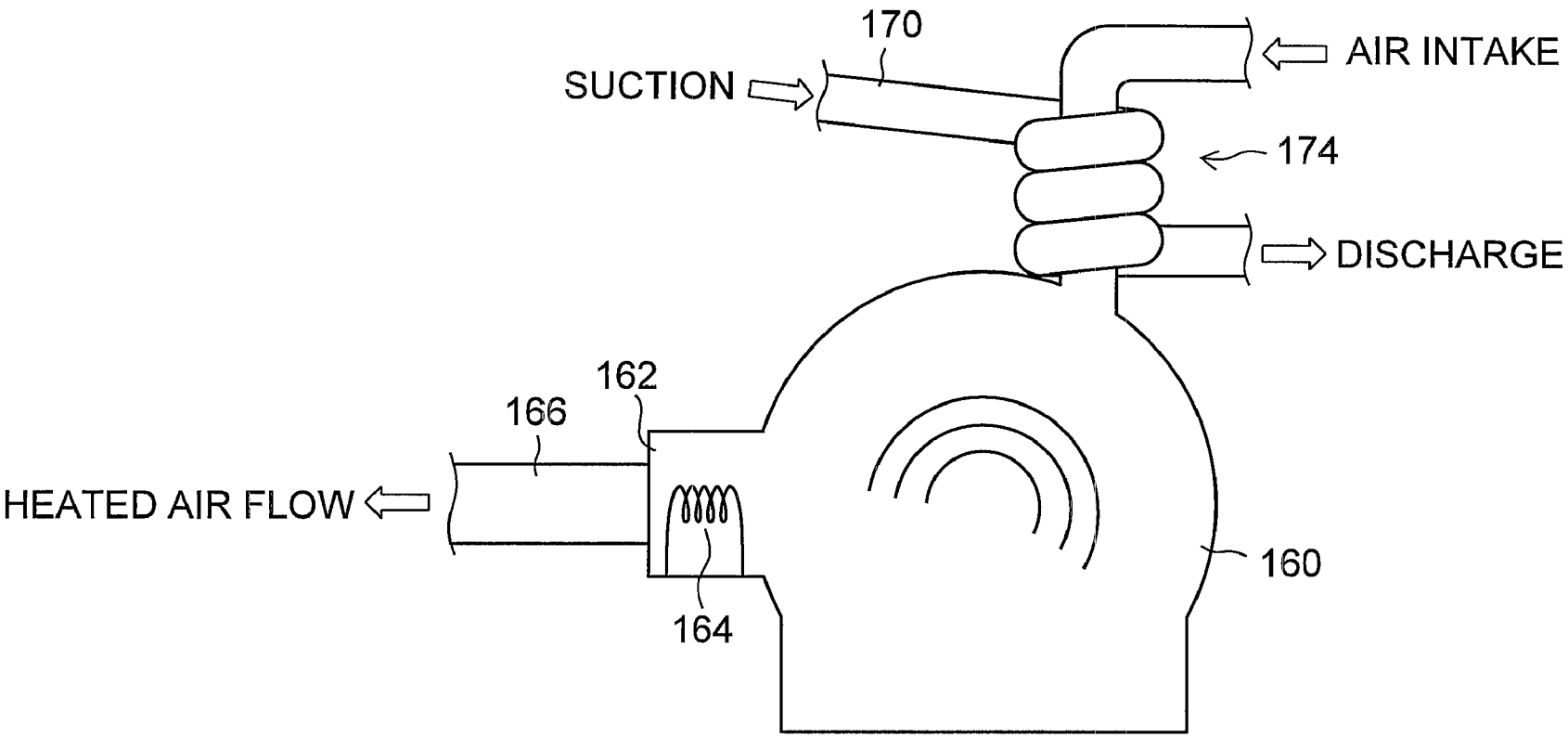
FIG. 14 illustrates an example of the composition of a heated air flow generating device.

FIG. 14 illustrates an example of the composition of the heated air flow generating device. As illustrated in FIG. 14, the heated air blowing device 160 which functions as a heated air flow generating device is provided with a heater 164 in the vicinity of air blowing port 162, and the air blowing port 162 is connected to the heated air flow supply port 114 of the heated air flow spraying member 96 (see FIG. 13) via a tube 166.

Furthermore, the suction connection port 154 of the conveyance guide 150 described in FIG. 13 is connected to the suctioning channel 170 in FIG. 14. The suctioning channel 170 composes a heat exchange section 174 in the vicinity of the air intake channel 172 of the air blowing device 160, and heat exchange is carried out by using the heat of the air sucked in from the conveyance guide 150 to heat the air taken into the air blowing device 160.

According to the composition described in FIG. 12 to FIG. 14, since the paper held by the grippers 91, 92 of the transfer drum 84 is suctioned by negative pressure to the conveyance guide 150, the recording surface (the surface onto which the permeation suppression agent is deposited) does not make contact with the members of the transfer drum 84 and even if the recording medium is heated and dried, problems such as wrinkling or denting are not liable to occur and the marks of the suction holes are not liable to be left in the medium.

Furthermore, in addition to a composition which suctions the heated air flow from the gap between sheets of paper on the conveyance guide 150, by also making the suctioning width of the conveyance guide 150 broader than the width of the paper, it is possible to move the heated air flow swiftly in the breadthways direction and therefore the drying of the paper and the discharge and recovery of the drying air flow are further stabilized (see FIG. 13).

By making the amount of suction of the conveyance guide 150 greater toward the upstream side of the conveyance direction, by for instance increasing the diameter and number of suction holes 142, the discharge efficiency of the drying air flow after the trailing end of the paper has left the conveyance guide 150 is further improved. Furthermore, by increasing the amount of suction in the central portion in the breadthways direction, the paper suction properties are improved and suction loss in the case of paper of narrow width is also reduced. More specifically, it is desirable that the diameter of the apertures should be 0.5 mm to 3 mm, and that the apertures should be arranged in a staggered matrix fashion at a pitch of 2 to 5 times the hole diameter.

Figure 15:
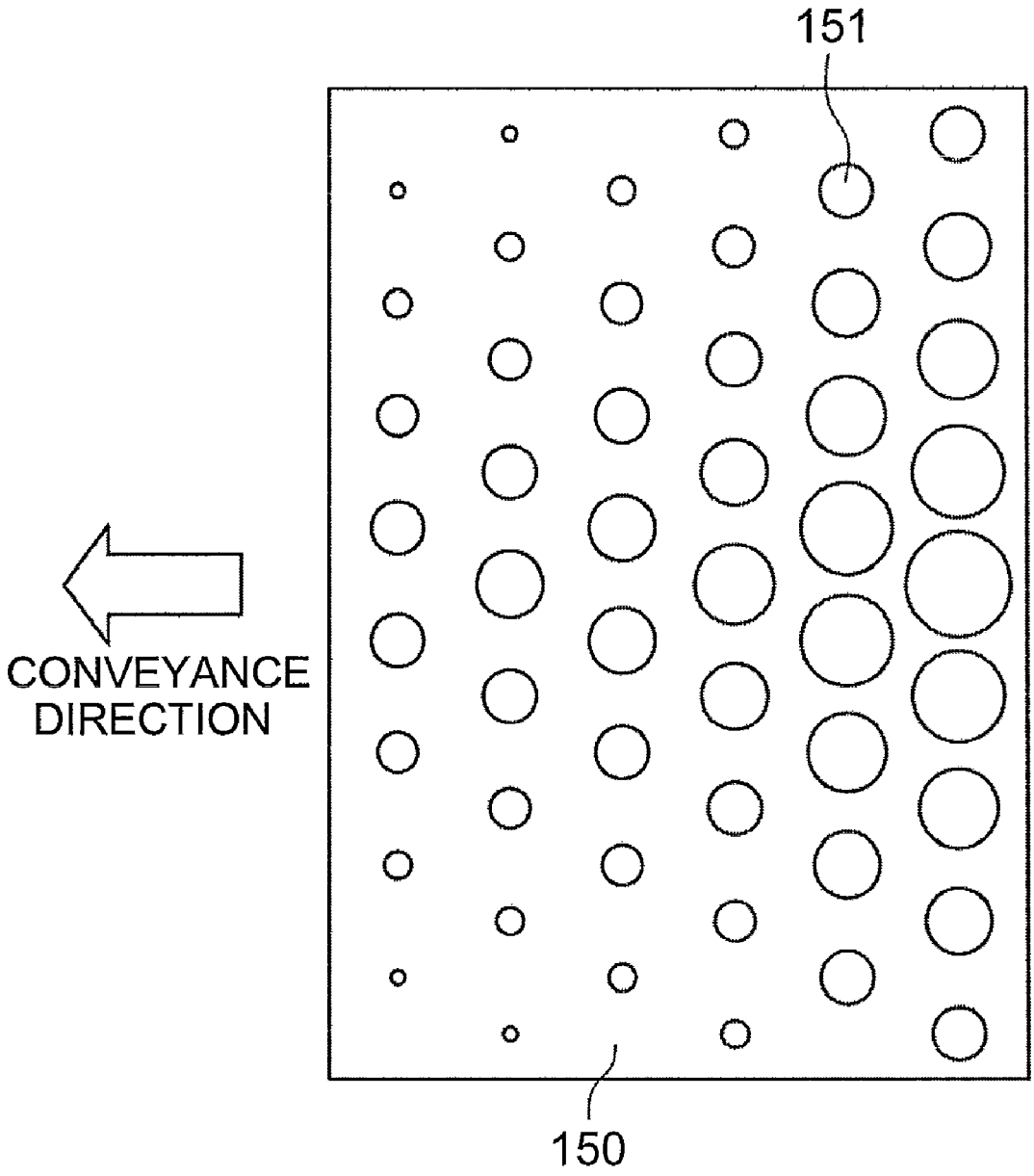
FIG. 15 is a plan view projection illustrating a schematic view of one example of a paper suction surface in a conveyance guide.

FIG. 15 is a plan view projection illustrating a schematic view of one example of the paper suctioning surface of the conveyance guide 150. In FIG. 15, the left-hand side is the downstream side in terms of the paper conveyance direction, and the up/down direction in the diagram is the breadthways direction of the paper. As illustrated in FIG. 15, desirably, the diameter of the apertures is made larger, the nearer the position toward the central portion in the breadthways direction, and furthermore the diameter of the apertures is made larger, the further the position toward the upstream side in the conveyance direction.

Figure 16:
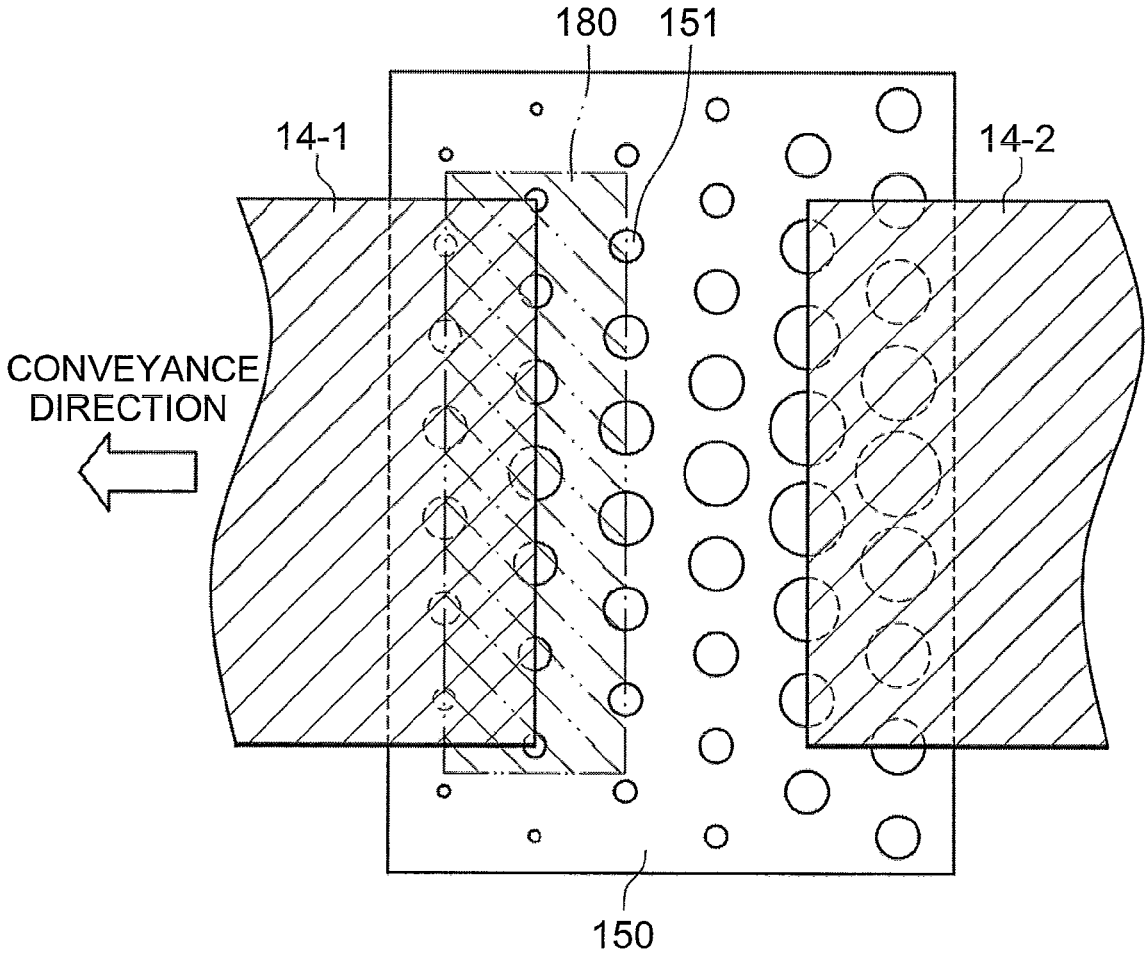
FIG. 16 is an explanatory diagram illustrating a schematic view of the relationship between the paper and the area heated air flow spraying area on the conveyance guide.

FIG. 16 is a plan diagram illustrating a schematic view of the relationship between the paper and the spraying area of the heated air flow on the conveyance guide 150. Reference numeral 14-1 in FIG. 16 indicates a sheet of paper on the downstream side, and reference numeral 14-2 indicates a following sheet of paper. Furthermore, the region indicated by the double-dotted lines in FIG. 16 (reference numeral 180) illustrates the spraying region of the heated air flow sprayed from the transfer drum 84 onto the preceding sheet of paper 14-1 which is on the downstream side.

Gap Between Sheets of Paper

As illustrated in FIG. 16, the gap between one conveyed sheet and the next is set in such a manner that, when at least one portion of both the downstream-side paper sheet 14-1 and the upstream-side paper sheet 14-2 is located in a position opposing the conveyance guide 150 (position capable of being suctioned), the flow volume suctioned from the gap between the paper sheets is greater than the flow volume sprayed from the heated air flow spraying member 96 onto the downstream-side paper sheet 14-1, and therefore even if the upper surface of the conveyance guide 150 is half closed-off by the downstream-side and upstream-side paper sheets 14-1 and 14-2, when evaporation occurs at the surface of paper conveyed on the transfer drum 84 by the grippers 91 or 92 so as to form a layer of wet air, the stagnation of the resulting water vapor is reduced, drying is promoted and soiling of the interior of the machine by water vapor is also prevented.

Figure 17:
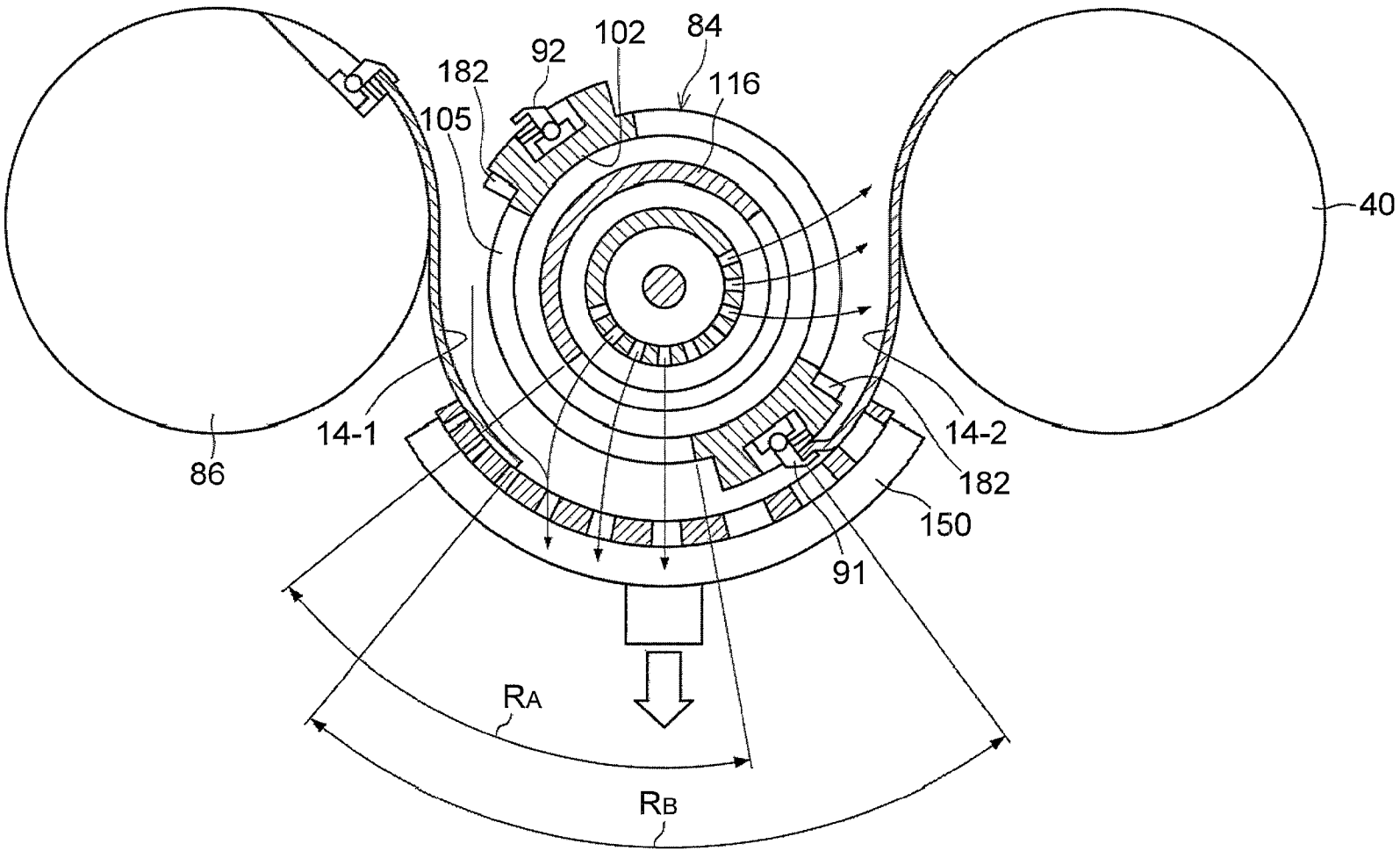
FIG. 17 is an explanatory diagram of the heated air flow spraying range in which heated air is sprayed from the transfer drum.

More specifically, the suction flow volume from the apertures of the conveyance guide 150 situated at a position corresponding to the gap between one paper sheet and another paper sheet is made greater than the maximum spray flow volume which is governed by the spray restricting member 116 and the apertures 104 and 105 of the transfer drum 84 when both the downstream-side paper sheet 14-1 and the upstream-side paper sheet 14-2 are located at positions opposing the conveyance guide 150. In particular, as illustrated in FIG. 17, it is desirable to adopt a composition in which the amount of suction is raised by making the suction angle $R_B$ which corresponds to the gap between the paper sheets greater than the spray angle $R_A$ which corresponds to the spraying range of the heated air flow on the downstream-side paper sheet 14-1, with reference to the center of rotation of the transfer drum 84, since this smoothes the air flow and reduces drying non-uniformities. The spray angle $R_A$ is determined by the edge of the opening of the spray restricting member 116 and the edge of the opening 104 of the transfer drum 84. The suction angle $R_B$ is determined by the trailing end of the downstream-side paper sheet 14-1 and the leading end of the upstream-side paper 14-2.

The amount of drying is adjusted by controlling the position of rotation of the spray restricting member 116 and adjusting the spray angle $R_A$, on the basis of the type of paper (coating layer, basis weight, and so on), the temperature and humidity, settings information such as the permeation suppression agent deposition volume and the treatment liquid deposition volume (described hereinafter), or determined information. Since the spraying range of the heated air flow can be controlled in this manner, then it is possible to spray a strong flow of heated air during an optimal time period only, and therefore the start up of drying is quick, defects in the molten state or film formation (void ratio) of the polymer particles, and variation in the drying state or permeation state of the solvent are reduced, and image quality and fixing quality can also be stabilized. By controlling an ultrasonic vibration type of oscillating device (not illustrated) which is provided in the conveyance guide 150, control having even better response can be achieved, and drying properties become even more stable.

Furthermore, sensors 182 forming devices for measuring the temperature and moisture content, such as an infrared thermometer and an infrared moisture meter, are provided in the vicinity of the grippers 91 and 92 of the transfer drum 84, and the spray restricting member 116 is controlled in accordance with the measurement results of the sensor 182. For example, by measuring the change over time (and in particular, the start-up characteristics) of the temperature and moisture content at the same position in the vicinity of the leading end of the paper, by means of a sensor 182, and by controlling the spray restricting member 116 on the basis of the measurement results, it is possible to correct the spraying range of the heated air flow in accordance with the paper being dried on the transfer drum 84, and therefore it is possible to carry out stable drying in accordance with the thickness and moisture absorption of the paper, and variation in the deposition volume of the permeation suppression agent and the deposition volume of the treatment liquid, which is described below. Reference numeral 184 in FIG. 13 indicates the contact point of the sensor 182.

Figure 18:
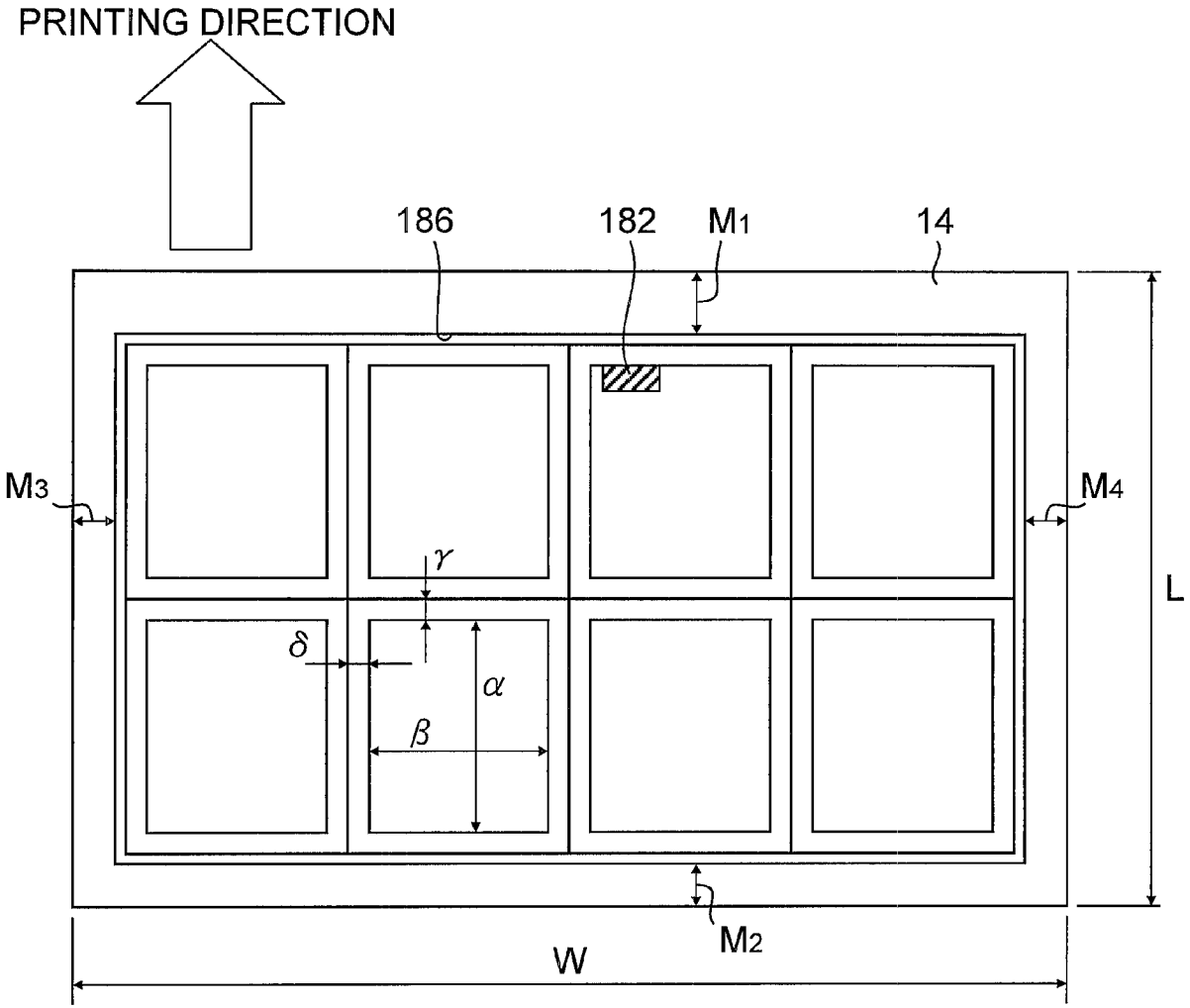
FIG. 18 is a diagram illustrating an example of a monitor apparatus based on a sensor.

FIG. 18 is a diagram illustrating an example of a monitor apparatus based on a sensor 182. Here, an example of (8-page) imposition printing is described, but the invention is not limited to a multiple image printing mode, and it is also possible to carry out printing of one page onto one sheet of paper.

The upward direction in FIG. 18 is the printing direction (paper conveyance direction), and of the paper size L×W, a printable region 186 is formed to the inside of a leading end margin M1 (the portion which is held by the grippers 91 and 92), a trailing end margin M2, a left-hand margin M3 and a right-hand margin M4. Permeation suppression agent is applied to the whole surface of the printable region 186. Image recording which ensures finished product dimensions $\alpha\times\beta$ and cutting margins $\gamma$, $\delta$ of a prescribed amount above, below and on the left and right-hand sides of the image is carried out inside this printable region.

In FIG. 18, a portion in the vicinity of the center of the paper in the breadthways direction, as indicated by the diagonal hatching, is the monitoring position of the sensor 182. The sensor 182 according to the present embodiment is a radiation thermometer. As described in FIG. 17, by providing a sensor 182 in the same position on each of the grippers 91 and 92 of the transfer drum 84, it is possible to determine the temperature from the time that the recording medium 14 is transferred to the transfer drum 84. By recording the temporal change in the temperature, it is possible to obtain the curve of the rise in the surface temperature from the start of drying of the recording medium 14 by the transfer drum 84 and the conveyance guide 150.

Figure 19:
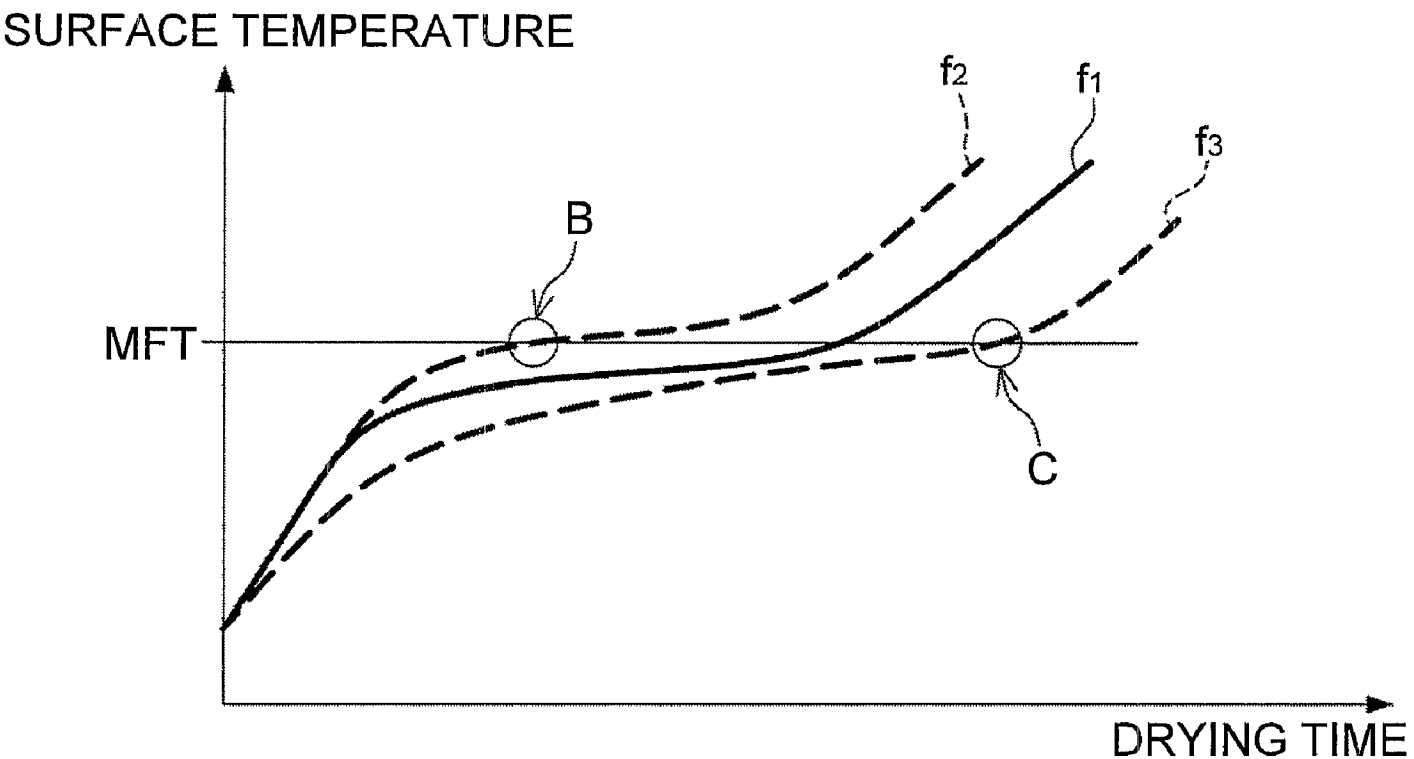
FIG. 19 is a graph illustrating temporal change in the surface temperature of the recording medium measured by the sensor.

FIG. 19 is a graph illustrating one example of the temporal change in the surface temperature thus obtained. The horizontal axis represents the drying time and the vertical axis represents the surface temperature. Furthermore, the "MFT" on the vertical axis indicates the minimum film forming temperature of the polymer which is added to the application liquid.

As illustrated in FIG. 19, the temperature rises sharply immediately after the start of determination, due to heating by the conveyance guide 150 and heating by the drying air flow sprayed from the transfer drum 84, and a layer of wet air is formed. Thereafter, as evaporation of water continues, the temperature reaches a certain balanced state, and when the solvent, such as water, decreases, the temperature rises again toward the right-hand side.

The deposition volume of the permeation suppression agent and the treatment liquid described below is equivalent to a liquid film thickness of 1 to 10 μm, and therefore temperature change occurs in a short period of time. By providing a radiation temperature sensor at the depicted position, the temperature quickly starts to rise after the grippers 91 or 92 have held the paper, and the rotation of the spray restricting member 116 is controlled by observing the gradient of this temperature change.

The solid line (f1) is a graph of a case where the amount of drying is controlled appropriately in accordance with the present embodiment. The broken line (f2) relates to a comparative example of a case where drying is too strong. In this case, drying defects are liable to occur due to the added polymer forming a film before the solvent, such as water, has evaporated (the polymer forms a film at the point indicated by reference symbol B). On the other hand, the broken line (f3) relates to a comparative example of a case where drying is too weak. In this case, the polymer forms a film at the point indicated by reference symbol C, but since it takes too much time to dry the solvent, such as water, then drying is not completed within the passage time over the conveyance guide 150 and the solvent, such as water, remains on the recording medium 14, and the printing characteristics and fixing characteristics achieved by the ink decline.

In the present embodiment, the amount of drying is controlled appropriately by measuring the temporal change in the surface temperature (f1), in such a manner that the problems associated with these comparative examples (f2) and (f3) do not occur.

A plurality of parameters can be envisaged for controlling the amount of drying, such as the temperature and the flow volume of the air flow, the amount of suction created by the conveyance guide 150, and so on. Here, instead of giving direct specific quantities for the spray volume of the heated air or the amount of suction in the gap between sheets of paper, a case is described which takes account of the relationship between factors which are correlated to these quantities, namely, the spraying range of the heated air flow in the paper conveyance direction, and the size of the gap between sheets of paper.

The transfer drum 84 according to the present example has a composition in which two sheets of paper are conveyed by two grippers, and therefore the gap between sheets of paper (the maximum gap in the case of continuous paper supply) is determined by the maximum length of the paper handled by the apparatus and the design diameter of the transfer drum 84. On the other hand, the spraying range of the flow of heated air (the spray angle $R_B$ illustrated in FIG. 17) can be controlled variably by means of the rotational position of the spray restricting member 116. The spraying start position of the drying air flow with respect to the recording medium 14 (the leading end position of the spraying range) is specified by the opening of the gripper supporting section 112, and is therefore uniform. The spraying end position (the trailing end position of the spraying range) can be adjusted on the basis of the position of the opening of the spray restricting member 116. By rotating the spray restricting member 116 in accordance with the measurement results of the surface temperature as obtained by the sensor 182, it is possible to control the end position of the spraying range of the drying air flow accurately. The larger the spraying range (spray angle) in the paper conveyance direction, the greater the amount of suction.

In FIG. 17, the upstream-side paper sheet 14-2 is in a state of initial conveyance by the conveyance guide 150, and is at a stage where a layer of wet air has been formed in the vicinity of the surface of the paper due to the heating by the conveyance guide 150 and the heated air flow sprayed from the transfer drum 84. At this stage, the amount of evaporated solvent, such as water, is still small.

Subsequently, the paper is conveyed to the downstream side following the conveyance guide 150 due to the rotation of the transfer drum 84, and during this a heating and drying process progresses (see FIG. 19). In the vicinity of the position of the downstream-side paper 14-1 in FIG. 17, there is a large amount of evaporation from the surface and vapor is generated.

By controlling the position of rotation of the spray restricting member 116 by measuring the temporal change (and desirably, the start-up characteristics) of the temperature and/or the solvent component, such as water, by means of the sensor 182, it is possible to correct the spraying range of the heated air flow in respect of the paper that is being dried on the transfer drum 84. By this means, it is possible to achieve stable drying in respect of variation in the thickness and moisture absorption of the paper, and the deposition volumes of the permeation suppression agent and the treatment liquid described below.

Next, a further example of the structure of the transfer drum (second example) is described.

Figure 20:
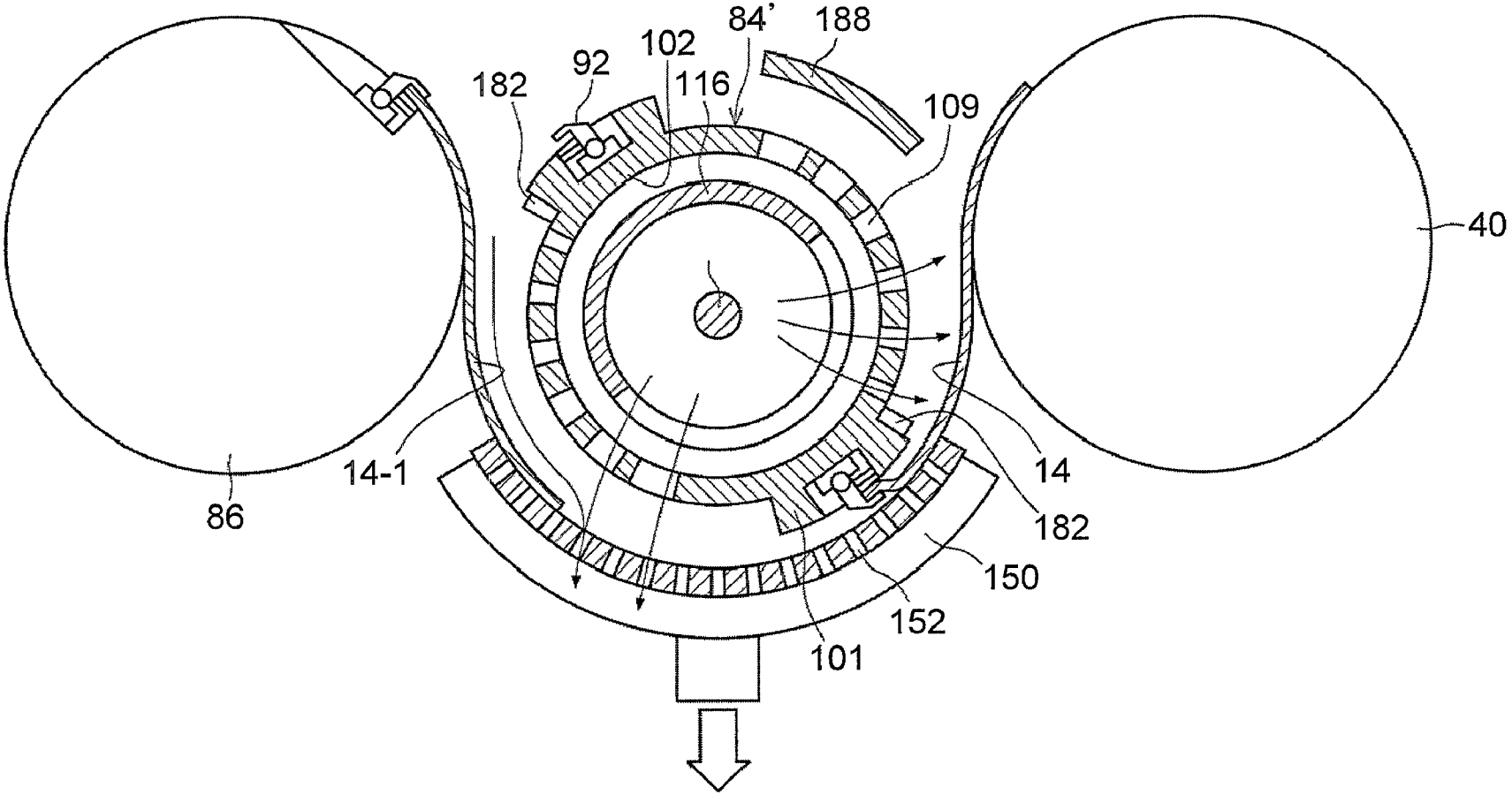
FIG. 20 is a cross-sectional diagram illustrating a further example of the composition of the transfer drum.

FIG. 20 illustrates an example of the structure of the transfer drum (second example). In FIG. 20, members which are the same as or similar to the composition described in FIG. 1 are labeled with the same reference numerals and description thereof is omitted here. The second example in FIG. 20 is a mode in which the function of the opening for spraying a heated air flow in the heated air flow spraying member 96 of the first example described in FIGS. 12 to 17 is achieved by an opening formed in the main body of the transfer drum.

In other words, as illustrated in FIG. 20, a plurality of apertures 109 for spraying a heated air flow in a radiating fashion are formed in the breadthways direction and the conveyance direction in the outer circumferential surface of the transfer drum 84' apart from the gripper holding sections 101 and 102. A spray restricting member 116 which controls the spraying range is provided inside the transfer drum 84'. The spray restricting member 116 is disposed coaxially with the transfer drum 84', and the rotation thereof can be controlled relatively with respect to the transfer drum 84', as well as being able to rotate in unison with the transfer drum 84'. By this means, the apertures for spraying 109 are maintained in a uniform relationship with respect to the recording medium 14.

Furthermore, a shielding member 188 for restricting the spray start position of the heated air flow onto the recording medium 14 is disposed to the outside of the transfer drum 84'. The shielding member 188 is disposed to the upstream side of the paper transfer section between the pressure drum 40 and the transfer drum 84' in terms of the direction of rotation of the transfer drum 84'. The heated air flow passing through the end portion 188A of the shielding member 188 is sprayed onto the recording medium 14 that has been transferred from the pressure drum 40 to the gripper 91 or 92. The shielding member 188 also performs a function of suppressing outflow of the heated air into unwanted parts inside the machine.

The composition of the conveyance guide 150 disposed so as to oppose the transfer drum 84' is as described in FIG. 12. If the suction width of the conveyance guide 150 is made broader than the paper width, then the heated air flow can be moved rapidly in the breadthways direction and the drying of the paper and the discharge and recovery of the drying air flow can be further stabilized. If the amount of suction of the conveyance guide 150 is made greater the further the position toward the upstream side in the conveyance direction, by increasing the diameter and/or number of the apertures, for instance, then the efficiency of discharge of the drying air flow after the trailing end of the paper has left the conveyance guide 150 is further improved, and by strengthening the central portion in the breadthways direction, the suctioning properties of the paper are improved and the suction loss in the case of paper of narrow width is also reduced.

Moreover, by increasing the spray volume of the spray apertures 109 formed in the circumferential surface of the transfer drum 84', through increasing the diameter and number of apertures, for instance, toward the trailing end of the paper and the central portion in the breadthways direction, the flow of drying air is made smoother and drying is further stabilized.

Figure 21:
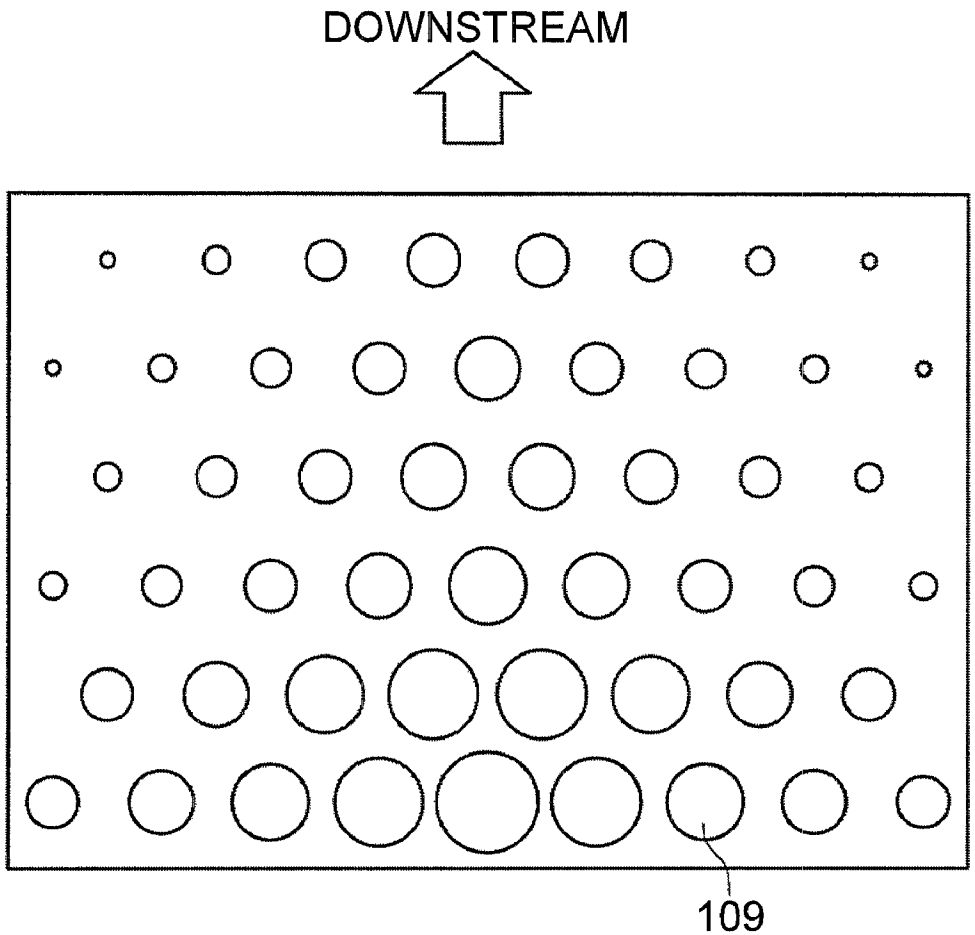
FIG. 21 is a plan view projection illustrating one example of the pattern of spray apertures.

FIG. 21 illustrates one example of this. FIG. 21 is a plan projection diagram illustrating a schematic view of an example of the formation of spray apertures 109 in the transfer drum 84'. In FIG. 21, the upper side is the downstream side in the paper conveyance direction (the leading end side of the paper). As illustrated in FIG. 21, desirably, the diameter of the apertures is made larger, the nearer the position toward the central portion in the breadthways direction, and furthermore the diameter of the apertures is made larger, the further the position toward the upstream side in the conveyance direction. More specifically, it is desirable that the diameter of the apertures should be 0.3 mm to 3 mm, and that the apertures should be arranged in a staggered matrix fashion at a pitch of 2 to 5 times the hole diameter.

According to the transfer drum 84' having the composition described above, as illustrated in FIG. 22, it is desirable to adopt a composition in which the amount of suction is raised by making the suction angle $R_B$ which corresponds to the gap between the paper sheets greater than the suction angle $R_A$ which corresponds to the spraying range of the heated air flow on the downstream-side paper sheet 14-1, with reference to the center of rotation of the transfer drum 84', since this smoothes the air flow and reduces drying non-uniformities.

Furthermore, spraying of a heated air flow that is not required for drying, for instance, on the opposite face of the conveyance guide 150, is prevented by means of the spray restricting member 116 which is provided on the inner side of the transfer drum 84', and the amount of drying can be adjusted on the basis of the type of paper (coating layer, basis weight, and the like), the humidity and temperature measured by the sensors 182, and settings information or determined information such as the deposition volume of permeation suppression agent or treatment liquid, which is described hereinafter.

Since the spraying range can be controlled in this way, then it is possible to spray a strong flow of heated air in an optimal time period only, and therefore the start-up of drying is quick and the temperature can be adjusted quickly to a temperature suited to the MFT (minimum film forming temperature) of the polymer particles. Consequently, defects in the molten state or film formation (void ratio), and variation in the dried volume or permeated volume of the solvent are reduced, and image quality and fixing quality can also be stabilized. By controlling an ultrasonic vibration type of oscillating device (not illustrated) which is provided in the conveyance guide 150, control having even better response can be achieved, and drying properties become even more stable.

Figure 22:
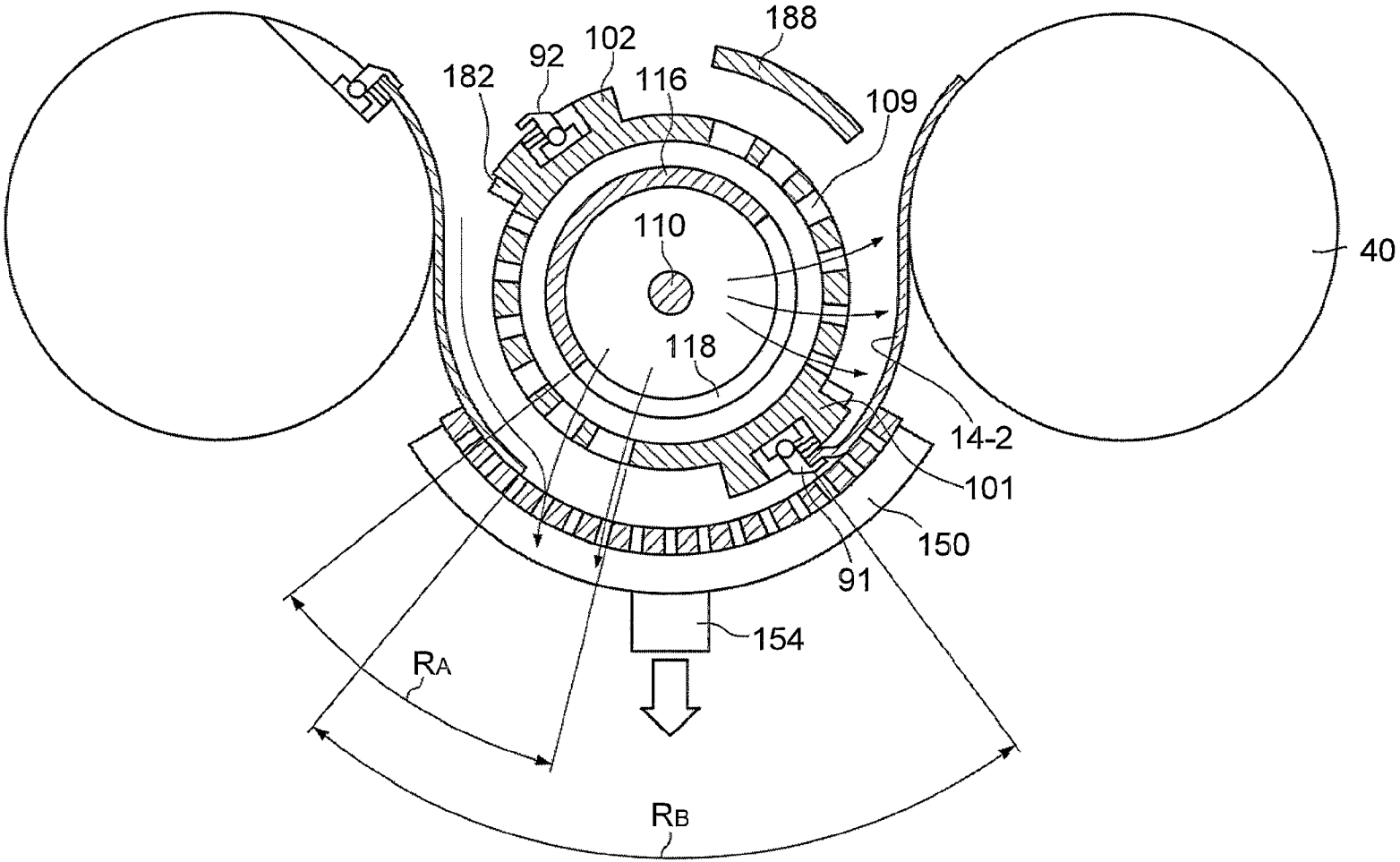
FIG. 22 is an explanatory diagram of the heated air flow spraying range in which heated air is sprayed from the transfer drum.

The composition of the transfer drum 84 (or 84') described in FIGS. 20 to 22 can also be applied to the other transfer drums 214 and 304 in FIG. 1. It is also possible to reduce floating up of the paper by raising the adhesion of the trailing end of the paper to the conveyance guide 150 by increasing the spray volume of the spray apertures 109 formed in the circumferential surface of the transfer drum 84' at the leading end of the paper, as well as at the trailing end of the paper and the central portion in the breadthways direction.

Description of Treatment Liquid Deposition Unit 26

Next, the treatment liquid deposition unit 26 (see FIG. 1) which is disposed in a stage after the transfer drum 84 will be described.

In the treatment liquid deposition unit 26, a treatment liquid head 202 and a treatment liquid drying unit 204 are provided respectively at positions opposing the circumferential surface of the pressure drum 86, in this order from the upstream side in terms of the direction of rotation of the pressure drum 86 (the counter-clockwise direction in FIG. 1).

The treatment liquid head 202 ejects droplets of treatment liquid onto a recording medium 14 which is held on the pressure drum 86 and adopts a composition similar to the ink heads 210Y, 210M, 210C, 210K disposed in the print unit 28, but it is also possible to adjust the shape and surface treatment of the nozzles, and the drive waveform, and the like, in accordance with the viscosity or surface tension of the treatment liquid (aggregating treatment agent), and the pH (hydrogen ion concentration), and so on.

The treatment liquid drying unit 204 employs a similar composition to the permeation suppression agent drying unit 46 of the permeation suppression processing unit 24 described above. A heater (not illustrated) of which the temperature is adjustable in the range of 50° C. to 130° C., and a fan (not illustrated) for blowing an air flow in the downstream direction at a rate of 5 m/s to 50 m/s are provided in the treatment liquid drying unit 204. When the recording medium 14 held on the pressure drum 86 of the treatment liquid deposition unit 26 passes downstream from a position opposing the treatment liquid drying unit 204, a warm air flow heated to 50° C. to 130° C. by means of the heater is directed by the fan onto the recording medium 14, thereby heating the recording medium 14, and pre-drying the treatment liquid.

The treatment liquid, such as aggregating treatment agent, used in the present embodiment is an acidic liquid which has the action of aggregating the coloring material contained in the inks which are ejected onto the recording medium 14 from respective ink heads 210K, 210C, 210M, 210Y disposed in the print unit 28 which are provided at a downstream stage. More specifically, it may be one of the treatment liquids described Table 2 given below, or a treatment liquid having an added acid, such as 2-pyrrolidone-5-carboxylic acid, phosphoric acid, succinic acid, citric acid, or the like.

It is also possible to obviate the need for the permeation suppression layer by suppressing the permeation of the treatment liquid by adding a small amount of high-boiling-point solvent, such as glycerine, or polymer particles such as LX-1, LX-2, or the like, as described in Table 1. Consequently, by applying a treatment liquid having a permeation suppressing effect of this kind by means of the liquid application apparatus 42, then the pressure drum 86, the treatment liquid head 202 and the treatment liquid drying unit 204, and the like, of the treatment liquid deposition unit 26 all become unnecessary.

The print unit 28 is provided after the treatment liquid deposition unit 26. A transfer drum 214 is provided between the pressure drum 86 of the treatment liquid deposition unit 26 and the pressure drum 216 of the print unit 28, so as to make contact with same. By this means, treatment liquid is deposited onto the recording medium 14 held on the pressure drum 86 of the treatment liquid deposition unit 26, thereby forming a layer of aggregating treatment agent, whereupon the recording medium 14 is transferred via the transfer drum 214 to the pressure drum 216 of the print unit 28 by the grippers (not illustrated).

A conveyance guide 150 is provided at a position opposing the circumferential surface of the transfer drum 214, similarly to the transfer drum 84. While the printed surface is conveyed in a non-contact fashion due to the heated air flow at a temperature of 50° C. to 130° C. which is blown out from the transfer drum 214 and the negative pressure suction-type of conveyance guide 150 which is adjusted to a temperature of 50° C. to 90° C., the printed surface is heated and dried in a range of 40° C. to 60° C., and an aggregating treatment agent layer in a solid state or semi-solid state (a thin film layer of dried treatment liquid) is formed on the recording medium 14. Reference here to "aggregating treatment agent layer in a solid state or a semi-solid state" includes a layer having a liquid content of 0% to 70% as defined in (Expression 1) below.

Water content=Weight per unit surface area of water contained in treatment liquid after drying ($g/m^2$)/ Weight per unit surface area of treatment liquid after drying ($g/m^2$) Expression 1

The composition of the transfer drum 214 is similar to that of the transfer drums 84 and 84' of the permeation suppression processing unit 24 described above, and therefore further description thereof is omitted here.

Description of Print Unit 28

Ink heads 210K, 210C, 210M and 210Y which respectively correspond to inks of four colors of black (K), cyan (C), magenta (M) and yellow (Y) are provided in the print unit 28 at positions opposing the circumferential surface of the pressure drum 216, in this order from the upstream side in terms of the direction of rotation of the pressure drum 216 which has been adjusted to a temperature of 30° C. to 50° C. (the counter-clockwise direction in FIG. 1).

The ink heads 210K, 210C, 210M and 210Y employ recording heads of an inkjet type (inkjet heads). The ink heads 210K, 210C, 210M and 210Y eject liquid droplets of the respectively corresponding color inks toward the recording medium 14 onto the recording medium 14 which is held by negative pressure suctioning or electrostatic attraction onto the pressure drum 216.

Although the configuration with the KCMY four standard colors is described in the present embodiment, combinations of the ink colors and the number of colors are not limited to those. Light inks, dark inks or special color inks can be added as required. For example, a configuration is possible in which ink heads for ejecting light-colored inks such as light cyan and light magenta are added. Furthermore, there are no particular restrictions of the sequence in which the heads of respective colors are arranged.

Structure of a Head

Next, the structure of each head will be described. The heads 210K, 210C, 210M and 210Y of the ink colors have the same structure, and a reference numeral 210 is hereinafter designated to any of the heads. A structure similar to the ink head 210 is also employed in the treatment liquid head 202 which is used in the treatment liquid deposition unit 26.

Figure 23A:
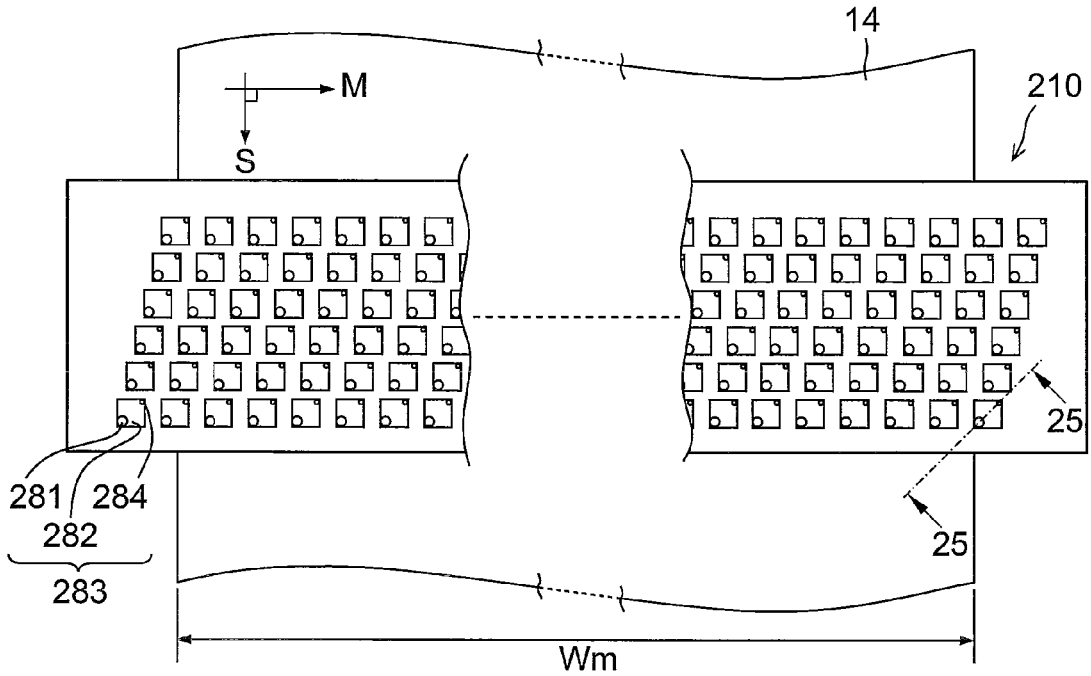
FIGS. 23A and 23B are plan view perspective diagrams illustrating an example of the composition of an ink head.
Figure 23B:
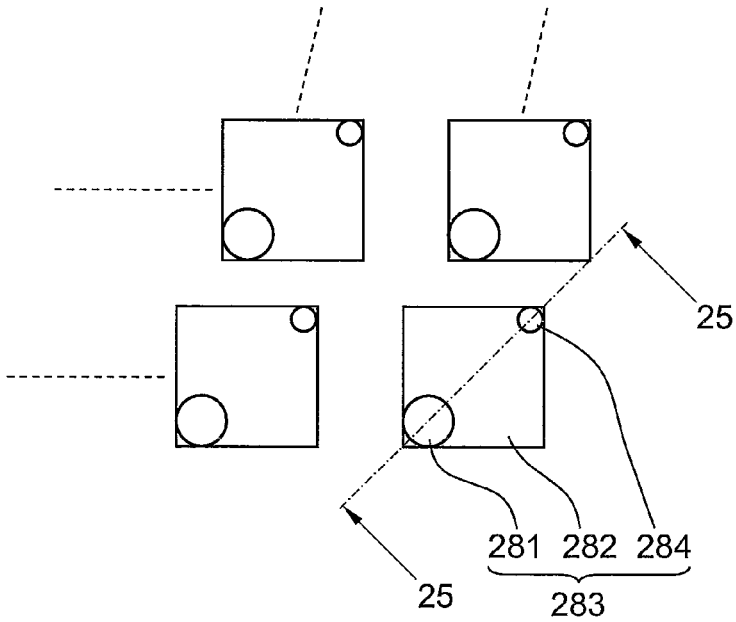

FIG. 23A is a perspective plan view illustrating an example of the configuration of the ink head 210 and FIG. 23B is an enlarged view of a portion thereof. The nozzle pitch in the ink head 210 should be minimized in order to maximize the density of the dots printed on the surface of the recording medium 14. As illustrated in FIGS. 23A and 23B, the ink head 210 according to the present embodiment has a structure in which a plurality of ink chamber units (droplet ejection elements) 283, each comprising a nozzle 281 forming an ink ejection port, a pressure chamber 282 corresponding to the nozzle 281, and the like, are disposed two-dimensionally in the form of a staggered matrix, and hence the effective nozzle interval (the projected nozzle pitch) as projected in the lengthwise direction of the head (the direction perpendicular to the paper conveyance direction) is reduced and high nozzle density is achieved.

Figure 24:
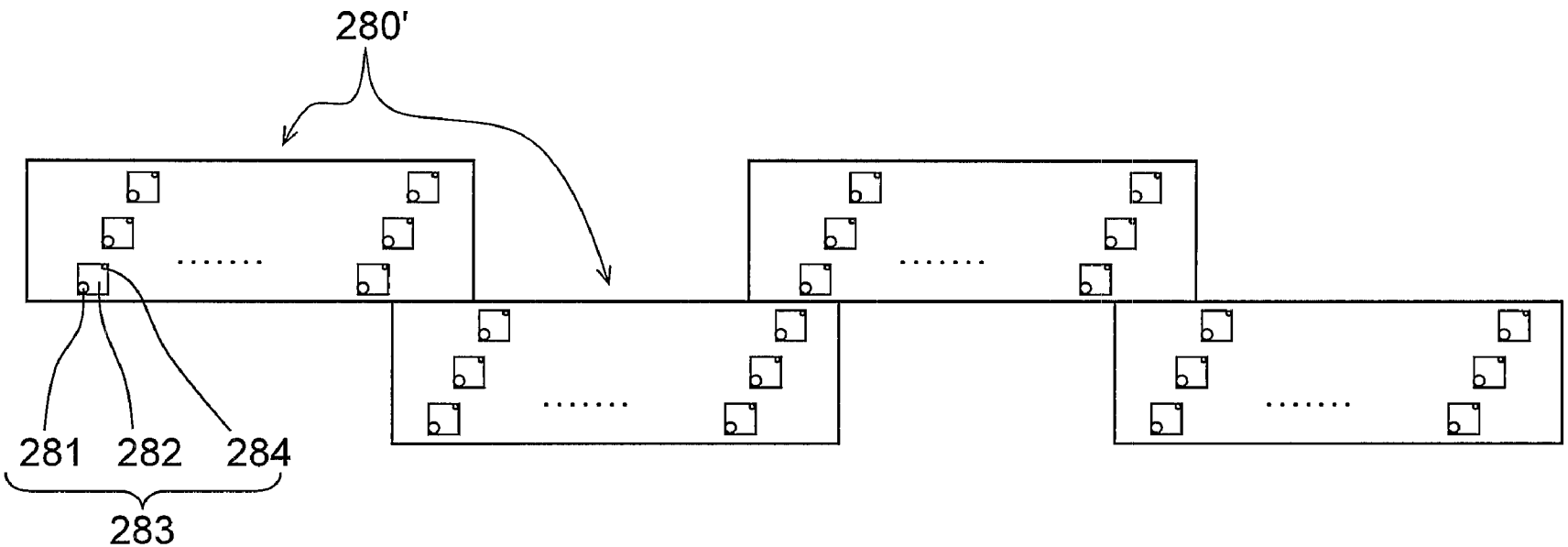
FIG. 24 is a plan diagram illustrating a further example of the composition of a head.

The mode of forming one or more nozzle rows through a length corresponding to the entire width of the image forming region in a direction (illustrated by an arrow M in FIG. 23A) substantially perpendicular to the conveyance direction of the recording medium 14 (illustrated by an arrow S in FIG. 23A) is not limited to the example illustrated in FIG. 23A. For example, instead of the configuration in FIG. 23A, as illustrated in FIG. 24, a line head having nozzle rows of a length corresponding to the entire width of the image forming region of the recording paper 14 can be formed by arranging and combining, in a staggered matrix, short head modules 280' having a plurality of nozzles 281 arrayed in a two-dimensional fashion, thereby making the whole length of the line head longer.

As illustrated in FIGS. 23A and 23B, the planar shape of the pressure chamber 282 provided for each nozzle 281 is substantially a square, and an outlet to the nozzle 281 is disposed in one of the two corners on a diagonal line of the square, and an inlet of supplied ink (supply port) 284 is disposed in the other corner. The shape of the pressure chamber 282 is not limited to that of the present example and various modes are possible in which the planar shape is a quadrilateral shape (diamond shape, rectangular shape, or the like), a pentagonal shape, a hexagonal shape, or other polygonal shape, or a circular shape, elliptical shape, or the like.

Figure 25:
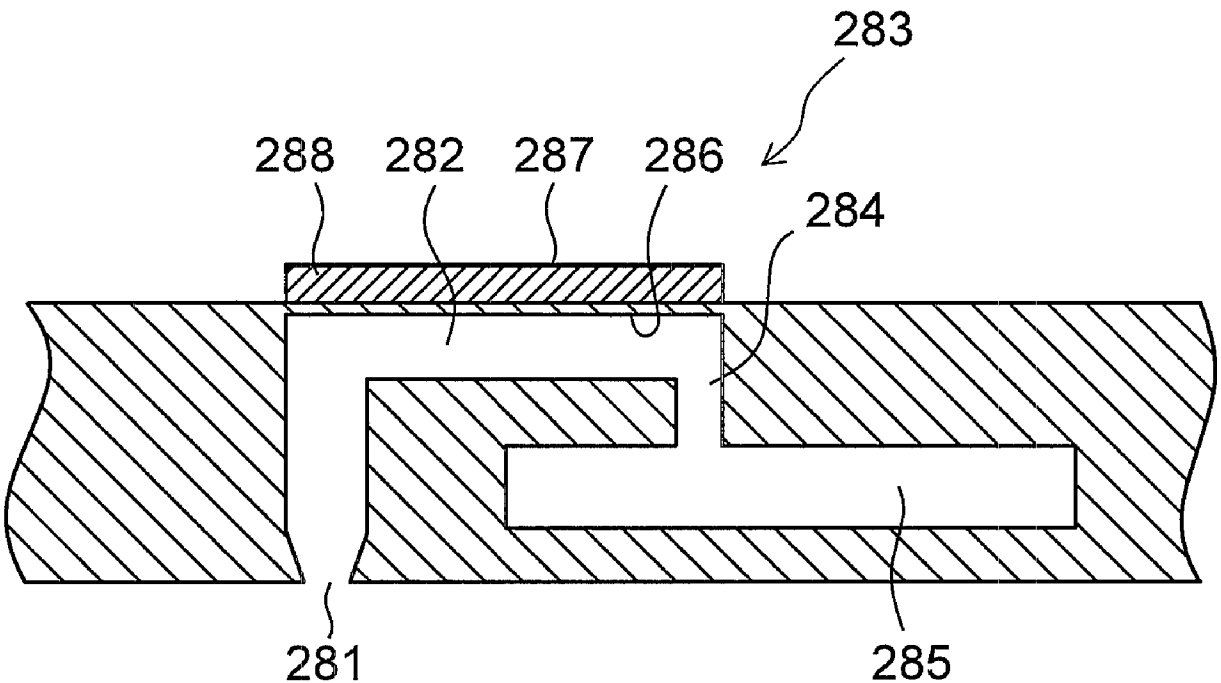
FIG. 25 is a cross-sectional view along line 25-25 in FIGS. 23A and 23B.

FIG. 25 is a cross-sectional diagram (along line 25-25 in FIGS. 23A and 23B) illustrating the three-dimensional composition of the liquid droplet ejection element of one channel which forms a recording element unit in the ink head 210 (an ink chamber unit corresponding to one nozzle 281).

As illustrated in FIG. 25, each pressure chamber 282 is connected to a common channel 285 through the supply port 284. The common channel 285 is connected to an ink tank (not illustrated), which is a base tank that supplies ink, and the ink supplied from the ink tank is supplied through the common flow channel 285 to the pressure chambers 282.

An actuator 288 provided with an individual electrode 287 is bonded to a pressure plate 286 (a diaphragm that also serves as a common electrode) which forms part of the surfaces of the pressure chamber 282 (the ceiling in FIG. 25). When a drive voltage is applied between the individual electrode 287 and the common electrode, the actuator 288 is deformed, the volume of the pressure chamber 282 is thereby changed, and the pressure in the pressure chamber 282 is thereby changed, so that the ink inside the pressure chamber 282 is thus ejected through the nozzle 281. The actuator 288 is desirably a piezoelectric element using a piezoelectric body such as lead zirconate titanate or barium titanate. After the ink is ejected and when the actuator 288 returns to its original state from the deformation, new ink is supplied to the pressure chamber 282 again from the common flow channel 285 through the supply port 284.

By controlling the driving of the actuators 288 corresponding to the nozzles 281 in accordance with the dot data generated from the input image by a digital half-toning process, it is possible to eject ink droplets from the nozzles 281. By controlling the ink ejection timing of the nozzles 281 in accordance with the speed of conveyance of the recording medium 14, while conveying the recording paper in the sub-scanning direction at a uniform speed, it is possible to record a desired image on the recording medium 14.

Figure 26:
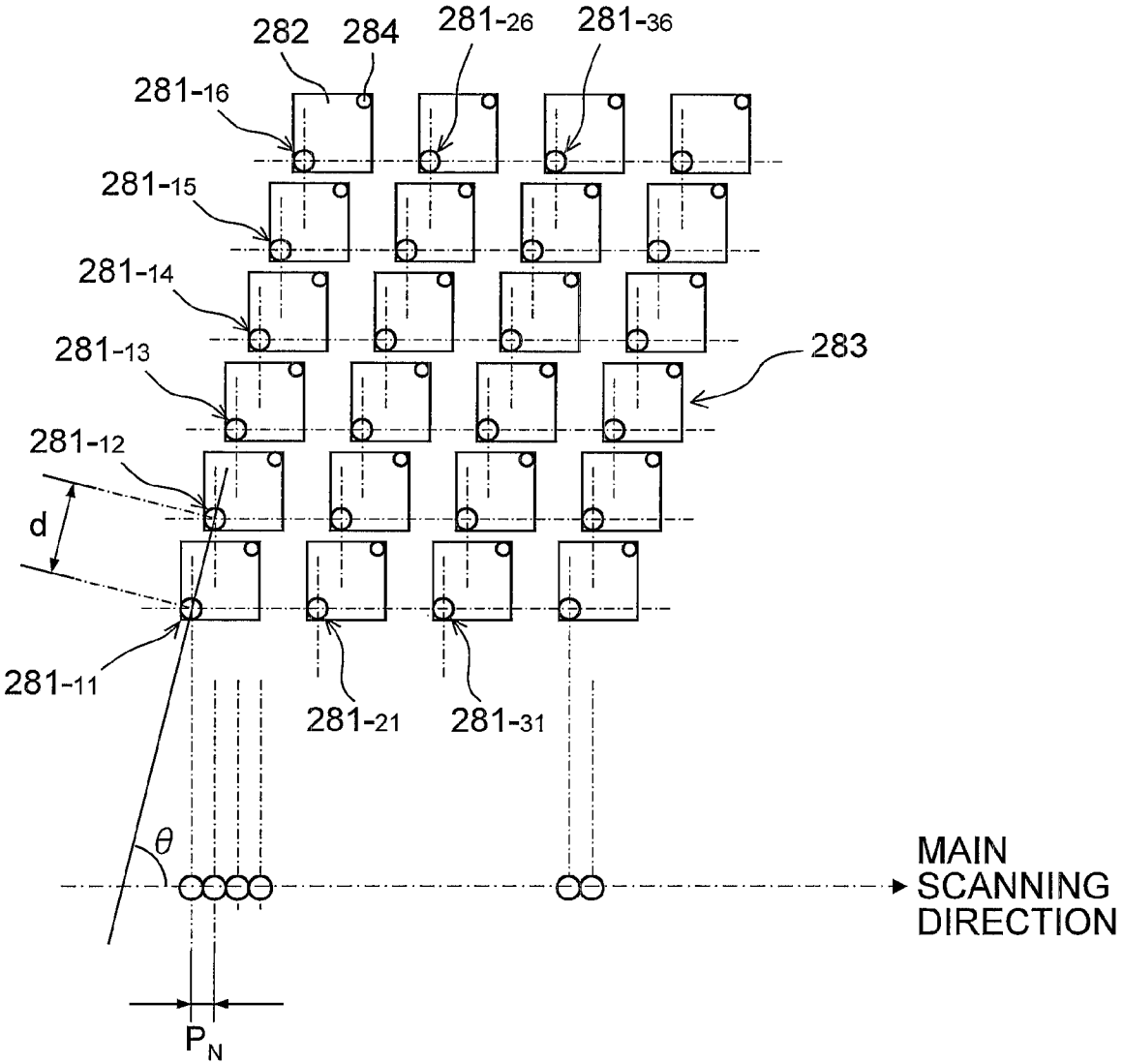
FIG. 26 is a plan diagram illustrating an example of the arrangement of nozzles in a head.

As illustrated in FIG. 26, the high-density nozzle head according to the present embodiment is achieved by arranging a plurality of ink chamber units 283 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 283 are arranged at a uniform pitch d in line with a direction forming an angle of θ with respect to the main scanning direction, the pitch PN of the nozzles projected (orthogonally projected) so as to align in the main scanning direction is $d \times \cos\theta$, and hence the nozzles 281 can be regarded to be equivalent to those arranged linearly at a fixed pitch P along the main scanning direction. According to such a configuration, the nozzle row projected so as to align in the main scanning direction can have a substantially high nozzle density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording medium 14(the direction perpendicular to the conveyance direction) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 281 arranged in a matrix such as that illustrated in FIG. 26 are driven, the main scanning according to the above-described (3) is preferred. More specifically, the nozzles 281-11, 281-12, 281-13, 281-14, 281-15 and 281-16 are treated as a block (additionally; the nozzles 281-21, 281-22, . . . , 281-26 are treated as another block; the nozzles 281-31, 281-32, . . . , 281-36 are treated as another block; . . . ); and one line is printed in the width direction of the recording medium 14 by sequentially driving the nozzles 281-11, 281-12, . . . , 281-16 in accordance with the conveyance velocity of the recording medium 14.

On the other hand, "sub-scanning" is defined as to repeatedly perform printing of one line (a line formed of a row of dots, or a line formed of a plurality of rows of dots) formed by the main scanning, while moving the full-line head and the recording medium 14 relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording medium 14 is called the sub-scanning direction and the direction perpendicular to same is called the main scanning direction. In implementing the present invention, the arrangement of the nozzles is not limited to that of the example illustrated.

In implementing the present invention, the arrangement of the nozzles is not limited to that of the example illustrated. Moreover, a method is employed in the present embodiment where an ink droplet is ejected by means of the deformation of the actuator 88, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Description of Solvent Drying Unit 30

The solvent drying unit 30 is provided following the print unit 28 (see FIG. 1). A transfer drum 304 is provided between the pressure drum 216 of the print unit 28 and the pressure drum 306 of the solvent drying unit 30 so as to lie in contact with both of these drums. By this means, after the respective color inks have been deposited on the recording medium 14 which is held on the pressure drum 216 of the print unit 28, the recording medium 14 is transferred via the transfer drum 304 to the pressure drum 306 of the solvent drying unit 30.

The composition of the transfer drum 304 is similar to that of the transfer drum 84 (or 84' in the drawing) of the permeation suppression processing unit 24 described above, and therefore further description thereof is omitted here.

A conveyance guide 150 is provided at a position opposing the circumferential surface of the transfer drum 304, similarly to the transfer drums 84 and 214. While the printed surface is conveyed in a non-contact fashion due to the heated air flow at a temperature of 50° C. to 130° C. which is blown out from the transfer drum 304 and the conveyance guide 150 using a negative pressure suction system which is adjusted to a temperature of 50° C. to 90° C., the printed surface is heated in a range of 40° C. to 60° C., a layer of wet air is formed on the surface, and of the water contained in the ejected droplets of ink, the water mainly present on the surface is evaporated off.

Furthermore, by providing a reflective optical sensor (not illustrated) on the transfer drum 304, reading in the optical density of a check pattern which has been printed onto the non-image portion of the recording medium 14 by means of the optical sensor, and correcting ink ejection volume in accordance with the read in results, it is possible to stabilize the image density. By providing both this optical sensor and the sensor 182 illustrated in FIG. 12, it is possible to correct the heating and drying conditions in real time, by measuring the temperature and moisture content of the check pattern printed on the non-image portion of the recording medium 14.

For instance, by determining the optical density (here, the amount of reflected light) of the check pattern (hereinafter, called "patch") by means of an optical element such as a photodiode, then the ink droplet ejection volume is monitored, and control of the ink ejection volume by means of the head drive voltage and correction of the ink droplet ejection pattern by means of image processing can be carried out in real time.

Furthermore, ink droplets are ejected onto portions of the recording medium 14 where the aggregating treatment agent has been applied and has not been applied, and by using an in-line sensor which is described hereinafter (reference numeral 348 in FIG. 1) to determine the degree of aggregation of the ink by measuring the optical density of the patch thus formed in the region where aggregating treatment agent has not been applied, as well as the patch in the region where the aggregating treatment agent has been applied, and the blank medium surface, the speed of revolution or impelling force of the application roller is controlled accordingly, thereby controlling the deposition volume of the aggregating treatment agent.

If a patch is formed by separate dots in a staggered matrix configuration, then apart from measuring the optical density, it is also possible to determine the degree of aggregation by measuring the dot diameter by using an imaging device, such as a CCD, for the in-line sensor, and in this case the aggregation can be determined with even greater accuracy.

The solvent drying unit 308 is disposed so as to oppose the circumferential surface of the pressure drum 306 to which the recording medium 14 is transferred from the transfer drum 304. It is also possible to use an infrared irradiation device or a heated air flow blowing device in the solvent drying unit 308. By irradiation of infrared energy or blowing a heated air flow by means of the solvent drying unit 308, the printed surface of the recording medium 14 on the pressure drum 306 is heated to 40° C. to 80° C., thereby sufficiently removing the water content, and lowering the viscosity of the high-boiling-point solvent, such as glycerine or diethylene glycol, which is contained in the ink for the purpose of preventing drying and adjusting the viscosity. Furthermore, by melting and forming a film of the polymer resin contained in the ink, it is also possible to improve the fixing properties. Voids are gradually formed in the permeation suppression layer that has been deposited on the permeation suppression treatment unit 24 by the action of the treatment liquid deposited by the treatment liquid deposition unit 26, thereby allowing the high-boiling-point solvent to permeate into the paper as well.

Description of Heat and Pressure Fixing Unit 32

The heat and pressure fixing unit 32 is provided after the solvent drying unit 30. A transfer drum 324 is provided between the pressure drum 306 of the solvent drying unit 30 and the pressure drum 326 of the heat and pressure fixing unit 32, so as to make contact with same. By this means, the water content of the inks of respective colors is removed from the recording medium 14 held on the pressure drum 306 of the solvent drying unit 30 and the viscosity of the high-boiling-point solvent is lowered, whereupon the recording medium 14 is transferred to the pressure drum 326 of the heat and pressure fixing unit 32 via the transfer drum 324.

The heat and pressure fixing unit 32 comprises heat rollers (fixing rollers) 328*a*, 328*b*, 328*c* which are adjusted to a temperature of 60° C. to 120° C., provided opposing the pressure drum 326 which is adjusted to a temperature of 40° C. to 80° C. Desirably, the heat rollers 328*a*, 328*b* and 328*c* are formed by coating (covering) the surface of rubber with a lyophobic material, such as PFA or fluorine elastomer, or the like, or applying a hard chrome plating to a rigid member. Furthermore, a cleaning unit 329 which has the function of applying a separating agent is abutted against the heat rollers 328*a*, 328*b* and 328*c*. For the separating agent, apart from silicon oil, which is generally used for separation purposes, it is also possible to use a high-boiling-point solvent which is permeable in the paper, and from the viewpoint of separating properties and glossiness, it is desirable to apply the separating agent to a thickness of 30 nm to 1 μm.

A stamp die member 325 using a wound nonwoven cloth, or the like, is provided in the transfer drum 324 and this stamp die member 325 absorbs the high-boiling-point solvent that has not permeated completely into the recording medium 14 during conveyance on the pressure drum 306 and the transfer drum 324.

A conveyance guide 150 is provided at a position opposing the circumferential surface of the transfer drum 324, similarly to the transfer drums 84, 214 and 304. While the printed surface is conveyed in a non-contact fashion due to the heated air flow at a temperature of 50° C. to 70° C. which is blown out from the transfer drum 324 and the conveyance guide 150 based on a negative pressure suction system which is adjusted to a temperature of 50° C. to 70° C., the printed surface is heated in a range of 40° C. to 60° C., and both the planar temperature distribution of the recording medium 14 that is heated to a high temperature by the solvent drying unit 308, and the film formation of the polymer resin, are made stable.

Consequently, by applying heat and pressure to the recording medium 14 which is transferred to the pressure drum 326 heated by the heating device (not illustrated), by means of the heat rollers 328*a*, 328*b* and 328*c*, the latex particles added to the ink are formed sufficiently into a film, thereby making the image permanent and fixing same to the recording medium 14.

Figure 27:
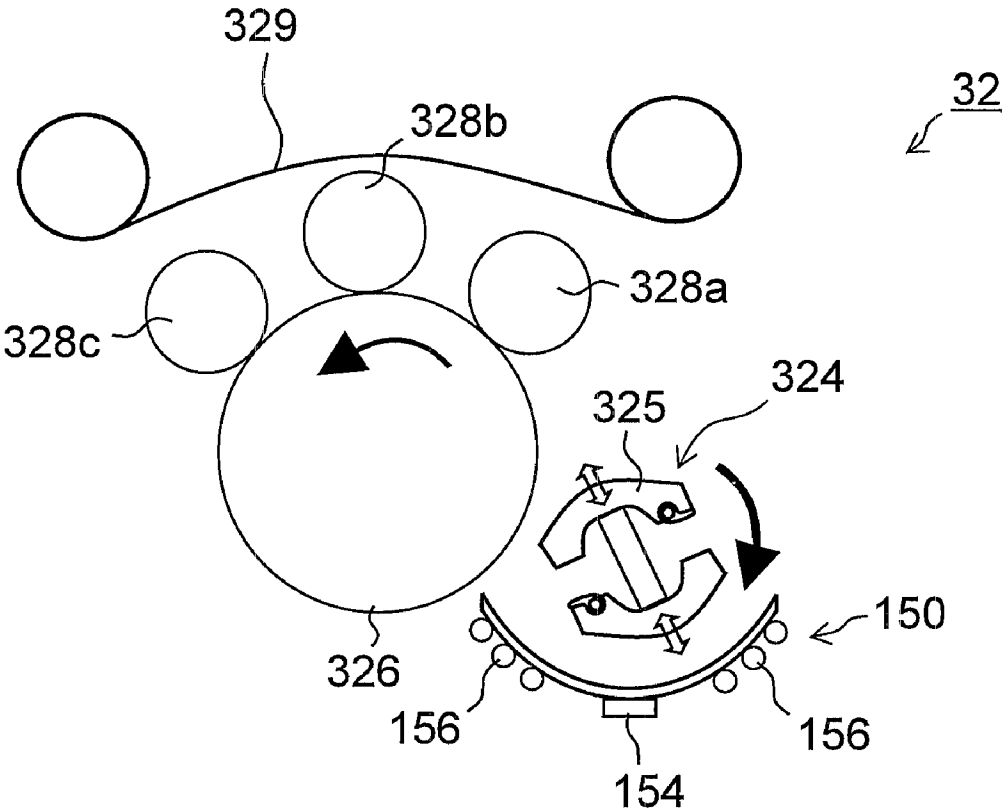
FIG. 27 is an enlarged diagram of a heat and pressure fixing unit.

FIG. 27 is an enlarged diagram of the heat and pressure fixing unit 32 and illustrates an overview of a switching roller type of heat and pressure fixing unit 32. By means of this switching roller type of heat and pressure fixing unit 32, it is possible to obtain a suitable surface glossiness in accordance with the recording medium 14.

More specifically, a heat roller 328*a* having a projection-recess surface formed by a matt-finish blasting process, a heat roller 328*b* having a smooth surface formed by PFA, or the like, coated onto a rubber surface, and furthermore a heat roller 328*c* having a smooth surface formed by PFA, or the like, coated onto a metal surface, are provided at positions opposing the circumferential surface of the pressure drum 326, in this order, from the upstream side in terms of the direction of rotation of the pressure drum 326 (the counter-clockwise direction in FIG. 27).

Furthermore, the nip pressure of the heat rollers is set to 0.5 MPa to 1.5 MPa in the case of the heat rollers 328*a* and 328*b* and 1 MPa to 2 MPa in the case of the heat roller 328*c*. Table 2 gives examples of combinations of nip (on) of the heat rollers 328*a*, 328*b* and 328*c* against the pressure drum 326 and separation (release) (off) of the rollers from the pressure drum 326.

TABLE 2

| Combination No. | Heater roller 328a | Heater roller 328b | Heater roller 328c | Use |
|---|---|---|---|---|
| 1 | off | off | off | Maintenance, error processing |
| 2 | off | off | on | Fixing to gloss coated paper |
| 3 | off | on | off | Fixing to matt gloss paper |
| 4 | off | on | on | Fixing to thick gloss coated paper Solid printing |
| 5 | on | off | off | Fixing to matt coated paper |
| 6 | on | off | on | Special finish |
| 7 | on | on | off | Special finish |
| 8 | on | on | on | Special finish |

As illustrated in Table 2, if the recording medium 14 is matt coated paper (combination No. 5),then only the heat roller 328*a* is nipped and the heat rollers 328*b* and 328*c* are separated from the pressure drum 326 by means of a release mechanism (not illustrated). By conveying the recording medium 14 in this state, a matt finish is applied to the surface and the image can be fixed reliably to the recording medium 14 by heat and pressure.

Furthermore, if the recording medium 14 is gloss coated paper (combination No. 2 in Table 2), then only the heat roller 328*c* is nipped and the heat rollers 328*a* and 328*b* are separated from the pressure drum 326 by means of a release mechanism (not illustrated). By conveying the recording medium 14 in this state, a gloss finish is applied to the surface and the image can be fixed reliably to the recording medium 14 by heat and pressure.

Furthermore, if the recording medium 14 is between matt coated paper and gloss coated paper (combination No. 3 in Table 2), then only the heat roller 328*b* is nipped and the heat rollers 328*a* and 328*c* are separated from the pressure drum 326 by means of a release mechanism (not illustrated). By conveying the recording medium 14 in this state, an intermediate finish is applied to the surface and the image can be fixed reliably to the recording medium 14 by heat and pressure.

Furthermore, if the recording medium 14 is thick gloss coated paper and solid printing is carried out (combination No. 4 in Table 2), then only the heat rollers 328*b* and 328*c* are nipped and the heat roller 328*a* is separated from the pressure drum 326 by means of a release mechanism (not illustrated).

Furthermore, in the event of maintenance of the apparatus, or error processing such as an application error or droplet ejection error on the recording medium 14, or a drying error (combination No. 1 in Table 2), then all of the heat rollers 328*a*, 328*b* and 328*c* are separated from the pressure drum 326.

Furthermore, apart from this, if the paper has a special finish (combinations Nos. 6, 7 and 8 in Table 2) then the heat rollers 328*a*, 328*b* and 328*c* are respectively nipped against the pressure drum 326 or separated from the pressure drum 326 as illustrated in Table 2.

Since the heat roller 328*a* positioned on the upstream side has a projection-recess surface, then even if the solvent is in the process of permeating into the recording medium 14, the adherence of ink to the roller is light. The heat roller 328*b* which is disposed to the downstream side has a smooth surface, but since the permeation of the solvent progresses during passage over the heat roller 328*a*, then the adherence of ink can be reduced, similarly to the heat roller 328*a*.

Furthermore, the heat roller 328*c* disposed on the downstream side has a smooth surface and a greater nip pressure, but since the permeation of solvent progresses during passage over the heat rollers 328*a* and 328*b*, then similarly to the heat rollers 328*a* and 328*b*, the adherence of ink can be reduced and reliable fixing can also be achieved.

Furthermore, the heat rollers 328*a*, 328*b* and 328*c* may combine the use of a plurality of rollers, and in this case, even more stable glossiness and fixing properties can be ensured, by setting the rollers in accordance with the thickness and permeation rate of the recording medium 14, the ink droplet ejection volume corresponding to the image, and other factors.

As illustrated in Table 2, in the event of maintenance of the apparatus, or error processing such as an application error or droplet ejection error on the recording medium 14, or a drying error, all of the heat rollers 328*a*, 328*b* and 328*c* are separated from the pressure drum 326.

Description of Output Unit 34

The output unit 34 is provided after the heat and pressure fixing unit 32. A transfer drum 344 is provided between the pressure drum 326 of the heat and pressure fixing unit 32 and an output tray 346 of the output unit 34 so as to lie in contact with both. By this means, the image on the recording medium 14 held on the pressure drum 326 of the heat and pressure fixing unit 32 is made permanent by the heat and pressure fixing unit 32, and the recording medium 14 is then transferred to the output tray 34 via the transfer drum 344 and output to the exterior of the machine.

The transfer drum 344 is heated by a heating device (which is not illustrated) and promotes further permeation of the high-boiling-point solvent and correction of curl in the recording medium 14.

Furthermore, an in-line sensor 348 such as a CCD or other imaging elements, or an infrared thermometer, infrared moisture meter, glossmeter, or the like, is disposed in the output unit 34, in order to measure the check pattern, moisture content, surface temperature, glossiness, or the like, of the recording medium 14. As stated previously, by measuring the optical density and dot diameter of the patch by means of the in-line sensor 348 and controlling the amount of aggregating treatment agent applied, by measuring patterns of various colors and correcting the color tones, by measuring the pattern at the leading and trailing ends and in the breadthways direction and correcting the rate of magnification, and by adjusting the fixing temperature in real time on the basis of the surface temperature of the medium, then stable quality is maintained in relation to glossiness, density, magnification rate, image distortion and positional deviation.

If the paper used for the recording medium 14 is a paper obtained by applying an absorbing layer with a pigment to binder ratio of about 5 to 20 at a thickness of 10 to 50 μm onto a base material, such as normal paper, and then applying and drying an aggregating component, such as an acid, before use, then the deposition of liquid by the permeation suppression processing unit 24 and the treatment liquid deposition unit 26 and the drying on the transfer drums 84 and 214 become unnecessary, and ink droplets are ejected directly onto the recording medium 14 which is transferred to the print unit 28.

If only paper of this kind is to be used, then the composition from the permeation suppression processing unit 24 to the transfer drum 214 can be omitted, and since the paper has an absorbing layer, then it is able to absorb the high-boiling-point solvent stably and the print quality can be improved yet further in comparison with generic papers.

Description of Control System

Figure 28:
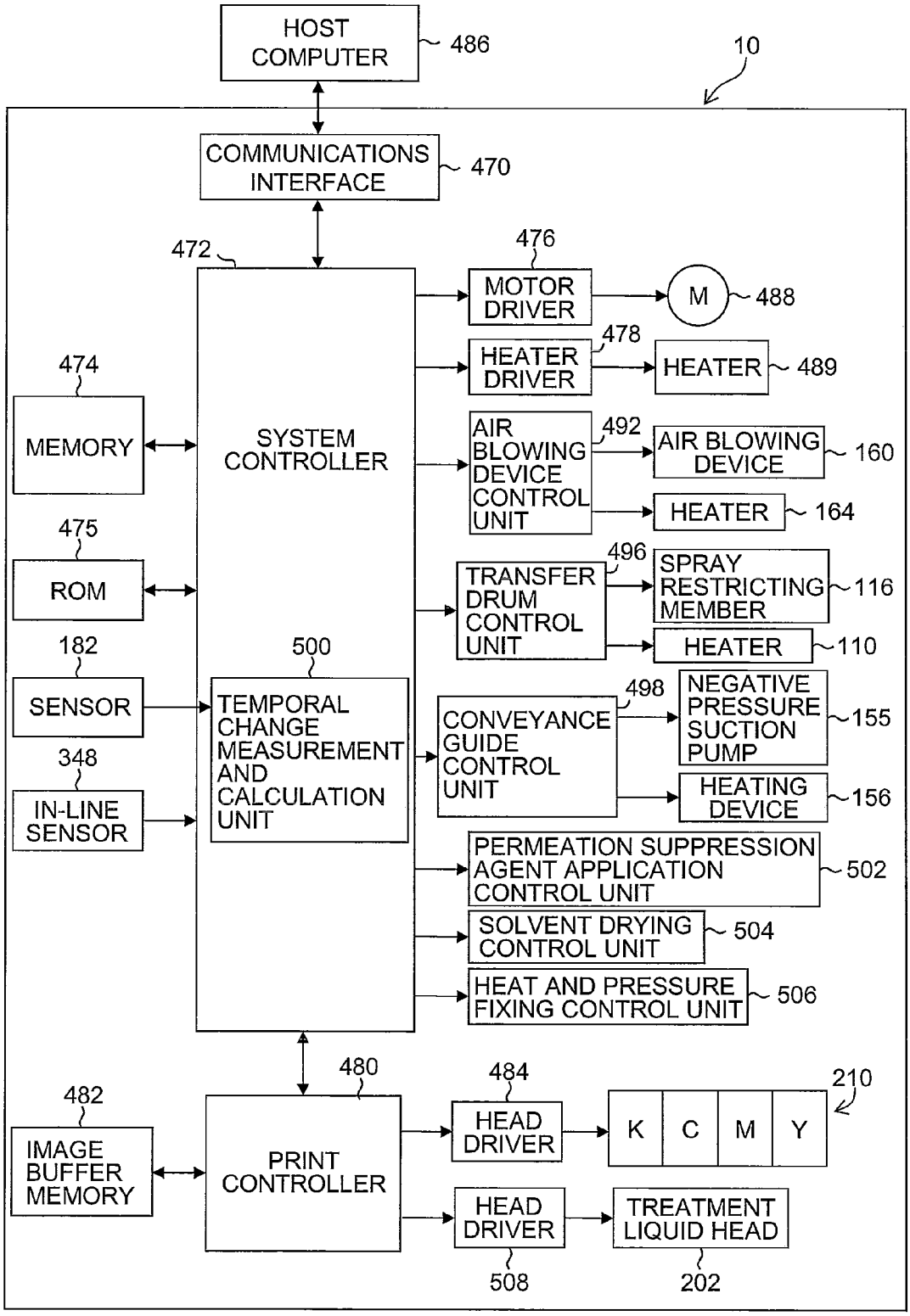
FIG. 28 is a block diagram illustrating the system composition of an inkjet recording apparatus.

FIG. 28 is a principal block diagram illustrating the system configuration of the inkjet recording apparatus 10. The inkjet recording apparatus 10 comprises a communications interface 470, a system controller 472, a memory 474, a ROM 475, a motor driver 476, a heater driver 478, a print control unit 480, an image buffer memory 482, a head driver 484, and the like.

The communications interface 470 is an interface unit for receiving image data sent from a host computer 486. A serial interface such as USB (Universal Serial Bus), IEEE1394, Ethernet (registered trademark), wireless network, or a parallel interface such as a Centronics interface may be used as the communications interface 470. A buffer memory (not illustrated) may be mounted in this portion in order to increase the communication speed. The image data sent from the host computer 486 is received by the inkjet recording apparatus 10 through the communications interface 470, and is temporarily stored in the memory 474.

The memory 474 is a storage device for temporarily storing images inputted through the communications interface 470, and data is written and read to and from the memory 474 through the system controller 472. The memory 474 is not limited to a memory composed of semiconductor elements, and a hard disk drive or another magnetic medium may be used.

The system controller 472 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 472 controls the various sections, such as the communications interface 470, memory 474, motor driver 476, heater driver 478, and the like, as well as controlling communications with the host computer 486 and writing and reading to and from the memory 474, and it also generates control signals for controlling the motor 488 and heater 489 of the conveyance system.

The program executed by the CPU of the system controller 472 and the various types of data which are required for control procedures are stored in the ROM 475. The ROM 475 may be a non-writeable storage device, or it may be a rewriteable storage device, such as an EEPROM. The memory 474 is used as a temporary storage region for the image data, and it is also used as a program development region and a calculation work region for the CPU.

The motor driver 476 is a driver which drives the motor 488 in accordance with instructions from the system controller 472. In FIG. 28, the motors disposed in the respective sections in the apparatus are represented by the reference numeral 488. The motor 488 includes motors which drive the respective pressure drums 40, 86, 216 306, 326, the transfer drums 84, 214, 304, 324, 344, the paper pressing member 44, the heat rollers 328*a*, 328*b*, 328*c*, and the like, illustrated in FIG. 1.

The heater driver 478 is a driver which drives the heater 489 in accordance with instructions from the system controller 472. In FIG. 28, the plurality of heaters which are provided in the inkjet recording apparatus 10 are represented by the reference numeral 489. Furthermore, the heater 489 includes the heaters of the permeation suppression agent drying unit 46, the treatment liquid drying unit 204, and the solvent drying unit 308, and the like.

The print control unit 480 has a signal processing function for performing various tasks, compensations, and other types of processing for generating print control signals from the image data stored in the memory 474 in accordance with commands from the system controller 472 so as to supply the generated print data (dot data) to the head driver 484. Prescribed signal processing is carried out in the print control unit 480, and the ejection amount and the ejection timing of the ink droplets from the respective ink heads 210 are controlled via the head driver 484, on the basis of the print data. By this means, desired dot size and dot positions can be achieved.

The print control unit 480 is provided with the image buffer memory 482; and image data, parameters, and other data are temporarily stored in the image buffer memory 482 when image data is processed in the print control unit 480. The aspect illustrated in FIG. 28 is one in which the image buffer memory 482 accompanies the print control unit 480; however, the memory 474 may also serve as the image buffer memory 482. Also possible is an aspect in which the print control unit 480 and the system controller 472 are integrated to form a single processor.

To give a general description of the sequence of processing from image input to print output, image data to be printed is input from an external source via a communications interface 470, and is accumulated in the memory 474. At this stage, RGB image data is stored in the memory 474, for example.

In this inkjet recording apparatus 10, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal gradations of the image (namely, the light and shade toning of the image) as faithfully as possible. Therefore, original image data (RGB data) stored in the memory 474 is sent to the print control unit 480 through the system controller 472, and is converted to the dot data for each ink color by a half-toning technique, using a threshold value matrix, error diffusion, or the like, in the print control unit 480.

In other words, the print control unit 480 performs processing for converting the input RGB image data into dot data for the four colors of K, C, M and Y The dot data generated by the print control unit 480 in this way is stored in the image buffer memory 482.

The head driver 484 outputs drive signals for driving the actuators 288 corresponding to the respective nozzles 281 of the ink heads 210, on the basis of the print data supplied by the print control unit 480 (in other words, the dot data stored in the image buffer memory 482). A feedback control system for maintaining constant drive conditions for the heads may be included in the head driver 484.

By supplying the drive signals output by the head driver 484 to the print heads 210 ink is ejected from the corresponding nozzles 281. An image (primary image) is formed on the recording medium 14 by controlling ink ejection from the ink heads 210 while conveying the recording medium 14 at a prescribed speed.

Furthermore, the system controller 472 functions as a device which controls the heated air flow drying based on the transfer drum 84, and the like, and the negative pressure suctioning by the conveyance guide 150, and duly controls the operation of a heated air flow control unit 492, a transfer drum control unit 496 and a conveyance guide control unit 498. The heated air flow control unit 492 controls the operation of the air blowing device 160 and the heater 164 illustrated in FIG. 14.

The transfer drum control unit 496 controls the drive mechanism of the spray restricting member 116 illustrated in FIG. 12, FIG. 13, and other drawings, as well as controlling the operation of the heater 110. The conveyance guide control unit 498 controls the operation of the negative pressure suction pump 155 which generates negative pressure and the heating device 156.

The system controller 472 performs the function of a temporal change measurement and calculation unit 500 which measures the temporal change in the determination signal (measurement information) obtained from the sensor 182, and controls the transfer drum control unit 496, or the like, in accordance with these calculation results. Furthermore, the system controller 472 controls the operation of the permeation suppression agent application control unit 502, the solvent drying control unit 504 and the heat and pressure fixing control unit 506.

Further, in the inkjet recording apparatus 10 of the present example, a treatment liquid head 202 and a head driver 508 which drives this head are provided as devices for depositing the treatment liquid. The head driver 508 generates drive signals to be applied to the actuators 288 (see FIG. 25) of the liquid head 202, on the basis of image data supplied from the print control unit 480, and also comprises drive circuits which drive the actuators 288 by applying the drive signals to the actuators 288. In this way, a desirable mode is one in which a composition for ejecting droplets of treatment liquid in accordance with the image data is adopted, and droplets of treatment liquid are ejected selectively onto the positions where droplets of ink have been ejected by the print unit 28, but it is also possible to adopt a mode in which the liquid is deposited in a uniform fashion by using a spray nozzle.

In the case of the liquid application apparatus 42 illustrated in FIG. 2, the permeation suppression agent application control unit 502 controls the roller abutment and separation mechanism drive device relating to the spiral roller 48, the rotational drive device of the spiral roller 48, the main blade abutment and separation mechanism drive device, and a precision regulator which adjusts the spraying pressure of the liquid spraying unit 52.

The solvent drying control unit 504 controls the operation of the solvent drying unit 308 in the solvent drying unit 30, in accordance with instructions from the system controller 472.

The heat and pressure fixing control unit 506 controls the operation of the stamp die member 325 in the heat and pressure fixing unit 32, as well as controlling the operation of the heat rollers 328*a* to 328*c* and the cleaning unit 329, in accordance with instructions from the system controller 472.

Furthermore, the measurement result data relating to the check pattern, moisture content, surface temperature, glossiness, and the like, are input to the system controller 472 from the in-line sensor 348 disposed in the output unit 34.

Operation of the Inkjet Recording Apparatus 10

The action of the image forming apparatus 10 which is composed in this way will now be described.

The recording medium 14 which has been supplied from the paper supply tray 36 is supplied via the transfer drum 38 to the circumferential surface of the pressure drum 40 of the permeation suppression processing unit 24 by a gripper (not illustrated).

Before being conveyed to the paper supply tray 36, the recording medium 14 is previously stacked in a paper supply unit (not illustrated) which is preheated to 40° C. to 50° C. The recording medium 14 is supplied to the transfer drum 38 while making contact with an adhesive roller 37 which is provided at a position opposing the paper supply surface of the paper supply tray 36. In this way, the recording medium 14 is heated and dried by preheating the paper supply unit, and it becomes possible to remove foreign material, such as paper dust, or other dust and dirt, by means of the recording medium 14 making contact with the adhesive roller 37, and faster and more stable drying after the application of permeation suppression agent can be achieved.

The recording medium 14 is held on the pressure drum 40 of the permeation suppression processing unit 24, via the transfer drum 38, and permeation suppression agent is applied selectively to a desired region by the liquid application apparatus 42. Thereupon, the recording medium 14 held on the pressure drum 40 is heated by the permeation suppression agent drying unit 46 while being guided by the paper pressing member 44 and conveyed in the direction of rotation of the pressure drum 40, whereby the solvent component (liquid component) of the permeation suppression agent is evaporated off and thereby dried.

The recording medium 14 which has been subjected to permeation suppression processing in this way is transferred from the pressure drum 40 of the permeation suppression processing unit 24 via the transfer drum 84 to the pressure drum 86 of the treatment liquid deposition unit 26. On the transfer drum 84, the permeation suppression agent is heated and dried by the conveyance guide 150, by non-contact drying of the printed surface. Droplets of treatment liquid are ejected by the treatment liquid head 202 onto the recording medium 14 which is held on the pressure drum 86. Thereupon, the recording medium 14 which is held on the pressure drum 86 is heated by the treatment liquid drying unit 204, and the solvent component (liquid component) of the treatment liquid is evaporated and dried. By this means, a layer of aggregating treatment agent in a solid state or semi-solid state is formed on the recording medium 14.

The recording medium 14 on which a solid or semi-solid layer of aggregating treatment agent has been formed is transferred from the pressure drum 86 of the treatment liquid deposition unit 26 via the transfer drum 214 to the pressure drum 216 of the print unit 28. On the transfer drum 214, acid is left on the permeation suppression layer by the non-contact drying of the printed surface by the conveyance guide 150. Droplets of corresponding colored inks are ejected respectively from the ink heads 210K, 210C, 210M and 210Y, onto the recording medium 14 held on the pressure drum 216, in accordance with the input image data.

When ink droplets are deposited onto the aggregating treatment agent layer, then the contact surface between the ink droplets and the aggregating treatment agent layer has a prescribed surface area when the ink lands, due to a balance between the propulsion energy and the surface energy. An aggregating reaction starts immediately after the ink droplets have landed on the aggregating treatment agent, but the aggregating reaction starts from the contact surface between the ink droplets and the aggregating treatment agent layer. Since the aggregating reaction occurs only in the vicinity of the contact surface, and the coloring material in the ink aggregates while receiving an adhesive force in the prescribed contact surface area upon landing of the ink, then movement of the coloring material is suppressed.

Even if another ink droplet is deposited adjacently to this ink droplet, since the coloring material of the previously deposited ink will already have aggregated, then the coloring material does not mix with the subsequently deposited ink, and therefore bleeding is suppressed. After aggregation of the coloring material, the separated ink solvent spreads, and a liquid layer containing dissolved aggregating treatment agent is formed on the recording medium 14.

The recording medium 14 onto which ink has been deposited is transferred from the pressure drum 216 of the print unit 28, via the transfer drum 304, to the pressure drum 306 of the solvent drying unit 30. On the transfer drum 304, the printed surface of the recording medium 14 is dried by a non-contact method, by the conveyance guide 150. On the pressure drum 306, the water content is removed sufficiently by irradiation of infrared energy and blowing of a heated air flow by the solvent drying unit 308.

Thereupon, the recording medium 14 is transferred to the pressure drum 326 of the heat and pressure fixing unit 32 from the pressure drum 306 of the solvent drying unit 30 and via the transfer drum 324. A stamp die member 325 is disposed on the transfer drum 324, and this stamp die member 325 absorbs the high-boiling-point solvent and causes same to permeate into the paper via the treatment liquid and the voids in the permeation suppression layer which have been increased by the heating and drying process. Furthermore, on the transfer drum 324, the printed surface of the recording medium 14 is dried by a non-contact method, by means of the conveyance guide 150. The image is fixed to the recording medium 14 by applying heat and pressure by means of the heat rollers 328*a*, 328*b*, 328*c* to the recording medium 14 that has been transferred to the pressure drum 326, which is heated by a heating device (not illustrated).

Thereupon, the recording medium 14 is transferred to an output tray 346 of the output unit 34 from the pressure drum 326 of the heat and pressure fixing unit 32 via the transfer drum 344, and is output to the exterior of the machine. The transfer drum 344 is heated by a heating device (which is not illustrated) and promotes further permeation of the high-boiling-point solvent and correction of curl in the recording medium 14.

MODIFICATION EXAMPLES

Figure 29:
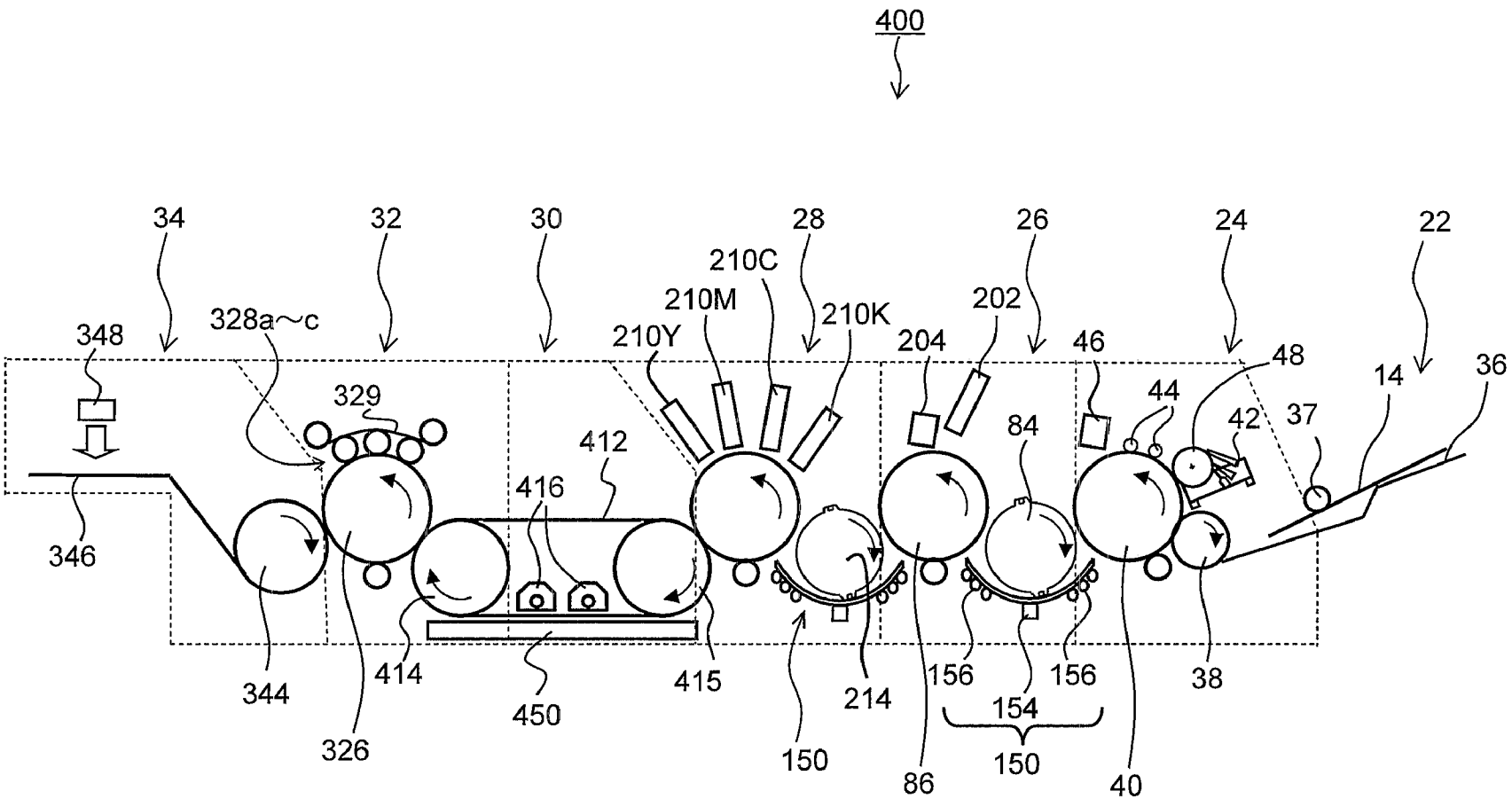
FIG. 29 is a schematic drawing of an inkjet recording apparatus relating to a further embodiment of the present invention.

FIG. 29 is a schematic drawing of an inkjet recording apparatus 400 relating to a further embodiment of the present invention. In FIG. 29, members which are the same as or similar to the composition described in FIG. 1 are labeled with the same reference numerals and description thereof is omitted here. Instead of the pressure drum 306 disposed in the solvent drying unit 30 and the transfer drums 304 and 324 disposed before and after same described in FIG. 1, it is also possible to adopt a mode which employs a conveyance device based on a chain 412 as in FIG. 29.

The chain 412 has grippers (not illustrated) for holding the recording medium 14. This chain 412 with grippers is wrapped about sprockets 414 and 415 for driving the chain, and a heated air flow spraying device 416 is provided inside the conveyance path of the chain 412. A negative pressure suction guide 450 which suctions the rear surface of the recording medium 14 with a negative pressure is disposed at a position opposing the conveyance surface of the chain 412.

This negative pressure suction guide 450 is composed similarly to the conveyance guide 150 described in FIG. 12, and performs a similar role to the conveyance guide 150. Drying is performed by spraying a heated air flow from the heated air flow spraying device 416 while conveying the recording medium 14 by the grippers of the chain 412 and suctioning the recording medium 14 with the negative pressure suction guide 450 disposed opposing same. Instead of or in combination with the heated air flow spraying device 416, it is also possible to perform heating and drying by using a drying unit similar to the solvent drying unit 308 illustrated in FIG. 1. In this case also, as well as obtaining similar beneficial effects as the inkjet recording apparatus relating to the embodiment illustrated in FIG. 1, the heating unit can be simplified, and therefore this mode is suitable for cases where the amount of drying is small, for instance, where the number of ink colors is small.

Preparation of Liquids

Next, adjustment examples of liquids used in the inkjet recording apparatuses according to the above-described embodiments are explained.

(1) Preparation of Permeation Suppression Agent

A mixed solution was prepared by mixing 10 g of a dispersion stabilizer resin (Q-1) having the following structure:

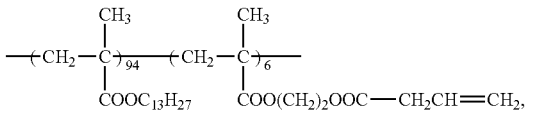

$\overline{M}w = 4 \times 10^4$ (Weight composition ratio)

100 g of vinyl acetate and 384 g of Isopar H (made by ExxonMobil), and was heated to a temperature of 70° C. while being agitated in a nitrogen gas flow. Then, 0.8 g of 2,2'-azobis(isovaleronitrile) (A.I.V.N.) was added as a polymerization initiator, and the mixture was made to react for 3 hours. 20 minutes after adding the polymerization initiator, white turbidity was produced and the reaction temperature rose to 88° C. A further 0.5 g of polymerization initiator was added and after making reaction for 2 hours, the temperature was raised to 100° C. and the mixture was agitated for 2 hours. Then, vinyl acetate that had not reacted was removed. The mixture was cooled and then passed through a 200-mesh nylon cloth. The white dispersed material thereby obtained was a latex having a polymerization rate of 90%, an average particle size of 0.23 μm and good monodisperse properties. The particle size was measured with a CAPA-500 (made by HORIBA, Ltd.).

A portion of the white dispersed material was placed in a centrifuge (for example, rotational speed: $1\times10^4$ r.p.m.; operating duration: 60 minutes), and the precipitated resin particles were collected and dried. The weight-average molecular weight (Mw), glass transition point (Tg) and minimum film forming temperature (MFT) of the resin particles were measured as follows: Mw was $2\times10^5$ (GPC value converted to value for polystyrene), Tg was 38° C. and MFT was 28° C.

(2) Preparation of Aggregating Treatment Agent

<Preparation of Treatment Liquid T-1>

As a result of preparation of the treatment liquid in accordance with the composition shown in the following Table 3 and measurement of properties of the reaction liquid thus obtained, the viscosity was 4.9 mPa·s, the surface tension was 24.3 mN/m and the pH was 1.5.

TABLE 3

| Material | Weight % |
|---|---|
| Malonic acid (made by Wako Pure Chemical Industries) | 10 |
| Diethylene glycol monomethyl ether (made by Wako Pure Chemical Industries | 15 |
| Trioxypropylene glyceryl ether (Sannix GP250 (made by Sanyo Chemical Industries, Ltd.)) | 5 |
| Latex LX-2 | 2 |
| Zonyl FSN-100 (made by Du Pont) | 1 |
| Deionized water | 67 |

By using the above aggregating treatment agent, it is possible to deposit the aggregating treatment agent bringing about good effects on the head ejection performance and the wettability of the recording medium.

(3) Preparation of Ink

<Preparation of Polymer Dispersant P-1>

88 g of methylethyl ketone was introduced into a 1000 ml three-mouthed flask fitted with an agitator and cooling tube, and was heated to 72° C. in a nitrogen atmosphere, whereupon a solution formed by dissolving 0.85 g of dimethyl 2,2'-azobis isobutylate, 60 g of benzyl methacrylate, 10 g of methacrylic acid and 30 g of methyl methacrylate in 50 g of methylethyl ketone was added to the flask by titration over three hours. When titration had been completed and after reacting for a further hour, a solution of 0.42 g of dimethyl 2,2'-asobis isobutylate dissolved in 2 g of methylethyl ketone was added, the temperature was raised to 78° C. and the mixture was heated for 4 hours. The reaction solution thus obtained was deposited twice in an excess amount of hexane, and the precipitated resin was dried, yielding 96 g of a polymer dispersant P-1.

The composition of the resin thus obtained was confirmed using a 1H-NMR, and the weight-average molecular weight (Mw) determined by GPC (Gel Permeation Chromatography) was 44600. Moreover, the acid number of the polymer was 65.2 mg KOH/g as determined by the method described in Japanese Industrial Standards (JIS) specifications (JIS K 0070-1992).

<Preparation of Cyan Dispersion Liquid>

10 parts of Pigment Blue 15:3 (phthalocyanine blue A220 made by Dainichi Seilca Color & Chemicals), 5 parts of the polymer dispersant P-1 obtained as described above, 42 parts of methylethyl ketone, 5.5 parts of an aqueous 1 mol/L NaOH solution, and 87.2 parts of deionized water were mixed together, and dispersed for 2 to 6 hours using 0.1 mm diameter zirconia beads in a beads mill.

The methylethyl ketone was removed from the obtained dispersion at 55° C. under reduced pressure, and moreover a portion of the water was removed, thus obtaining a cyan dispersion liquid having a pigment concentration of 10.2 wt %.

The cyan dispersion liquid forming a coloring material was prepared as described above.

Using the coloring material (cyan dispersion liquid) obtained as described above, an ink was prepared so as to achieve the ink composition indicated below (Table 4), and the prepared ink was then passed through a 5 μm filter to remove coarse particles, thereby obtaining a cyan ink C1-1. Thereupon, the physical properties of the ink C1-1 thus obtained were measured, and the pH was 9.0, the surface tension was 32.9 mN/m, and the viscosity was 3.9 mPa·s.

TABLE 4

| Material | Weight % |
|---|---|
| Cyan pigment (Pigment Blue 15:3) made by Dainichiseika Color & Chemicals Mfg. Co., Ltd.) | 4 |
| Polymer dispersant (P-1 mentioned above) | 2 |
| Latex LX-2 | 8 |
| Trioxypropylene glyceryl ether (Sannix GP250 (made by Sanyo Chemical Industries, Ltd.)) | 15 |
| Olefin E1010 (Nissin Chemical Industry Co., Ltd.) | 1 |
| Deionized water | 70 |

Magenta, yellow and black inks were also prepared in a similar manner.

(4) Added Polymers

Particles of polymer resin, or the like, are added as appropriate to the aggregating treatment agent and ink described above. Desirably, particles having a particle size of 1 μm or less and a glass transition point of 40° C. to 60° C. are added at a rate of 1% to 8%, to the aggregating treatment liquid, for the purpose of adjusting the glossiness, and to the ink, for the purpose of fixing the image.

TABLE 5

| Category | Composition | Particle size (diameter: μm) | Tg (° C.) | MFT (° C.) |
|---|---|---|---|---|
| LX-2 | Acrylic | 0.12 | 65 | 47 |
| | Styrene acrylic | 0.09 | 65 | 32 |
| | Styrene acrylic | 0.07 | 49 | 46 |

Tg: glass transition point

Liquid application methods, liquid application apparatuses and image forming apparatuses of embodiments of the present invention have been described in detail above, but the present invention is not limited to the examples described above, and improvements and modifications can be made without deviating from the gist of the present invention.

Appendix

As has become evident from the detailed description of embodiments of the present invention given above, the present specification includes disclosure of various technical ideas including at least the inventions described below.

One aspect of the present invention is directed to 1. An inkjet recording apparatus, comprising: a conveyance device which conveys a recording medium; a drying air flow spraying device which sprays a drying air flow onto the recording medium while the recording medium is conveyed by the conveyance device; a negative pressure suctioning device which opposes the drying air flow spraying device, and suctions a rear surface of the recording medium and suctions at least a portion of the drying air flow sprayed by the drying air flow spraying device while the recording medium is conveyed by the conveyance device; and an inkjet head which ejects ink to be deposited on the recording medium.

The drying air spraying device according to this aspect of the present invention may adopt a mode which sprays a drying air flow onto recording medium before ejecting droplets of ink by the inkjet head, or a mode which sprays a flow of drying air onto the recording medium after ejecting droplets of ink.

The "recording medium" may also be called a print medium, an image forming medium, a recording medium, or an image receiving medium, or the like. Furthermore, the recording medium is not limited to a case where an image is formed directly onto the medium, and the concept of "recording medium" also includes an intermediate transfer body onto which a primary image is formed provisionally and then transferred so as to record the image (secondary image) onto paper, or the like. There are no particular restrictions on the shape or material of the recording medium, which may be various types of media, irrespective of material and size, such as sheet paper (cut paper), sealed paper, continuous paper, resin sheets, such as OHP sheets, film, cloth, a printed circuit substrate on which a wiring pattern, or the like, is formed, a rubber sheet, a metal sheet, or the like.

One compositional example of an inkjet head is a full line type head in which a plurality of nozzles are arranged through a length corresponding to the full width of the recording medium. In this case, a mode may be adopted in which a plurality of relatively short recording head modules having nozzles rows which do not reach a length corresponding to the full width of the recording medium are combined and joined together, thereby forming nozzle rows of a length that correspond to the full width of the recording medium.

A full line type head is usually disposed in a direction that is perpendicular to the feed direction (conveyance direction) of the recording medium, but a mode may also be adopted in which the head is disposed following an oblique direction that forms a prescribed angle with respect to the direction perpendicular to the conveyance direction.

The conveyance device for causing the recording medium and the inkjet head to move relative to each other may include a mode where the recording medium is conveyed with respect to a stationary (fixed) head, or a mode where a head is moved with respect to a stationary recording medium, or a mode where both the head and the recording medium are moved. When forming color images by using an inkjet head, it is possible to provide heads for each color of a plurality of colored inks (recording liquids), or it is possible to eject inks of a plurality of colors, from one print head.

Desirably, the recording medium is cut sheet, and at least a portion of the drying air flow is suctioned from a gap between the recording media conveyed by the conveyance device.

According to this aspect of the invention, it is possible to stabilize drying by moving and discharging the drying air flow sprayed onto the recording medium, rapidly toward the downstream side of the conveyance direction.

Desirably, the negative pressure suctioning device is fixed in a conveyance path for the recording medium and also serves as a conveyance guide for the recording medium.

By suctioning from a fixing suctioning unit, it is possible to convey the recording medium is a stable fashion.

Desirably, the drying air flow sprayed by the drying air flow spraying device is in a temperature range of 50° C. to 130° C.

For example, desirably, the temperature of the sprayed heated air flow is set to a suitable temperature by taking account of the properties (minimum film forming temperature) of the polymer particles which are added to the liquid deposited onto the recording medium.

Desirably, the inkjet recording apparatus comprises a heat reutilization device which uses heat of air suctioned by the negative pressure suctioning device to heat the drying air flow to be sprayed by the drying air flow spraying device.

The "heat reutilization device" may be a heat exchanger, circulating spray, or the like. By reutilizing the exhaust gas from the negative pressure suctioning device, the heat usage efficiency is improved and soiling due to vapor inside the apparatus can be prevented.

Desirably, the inkjet recording apparatus comprises a heating device which is formed with the negative pressure suctioning device and heats the recording medium from the rear surface of the recording medium.

By heating the rear surface of the recording medium which is suctioned by the negative pressure suctioning device, it is possible to achieve even faster drying while suppressing problems, such as wrinkling or denting.

Desirably, a width of a negative pressure suctioning region of the negative pressure suctioning device is greater than a width of the recording medium.

According to this aspect of the invention, it is possible to move the drying air flow rapidly in the breadthways direction, and hence stable drying and even more stable discharge and recovery of the drying air flow can be achieved.

Desirably, suctioning force of the negative pressure suctioning device varies with respect to a conveyance direction in which the recording medium is conveyed in such a manner that the suctioning force on an upstream side in the conveyance direction is greater than the suctioning force on a downstream side in the conveyance direction.

This mode achieves further improvement in the discharge efficiency of the drying air flow after the trailing end portion of the recording medium has left the negative pressure suctioning device during the conveyance of the recording medium. As a device for applying a gradient to the suctioning force, there is a mode where the aperture diameter of the suction holes and/or the number of suction holes is altered, for example. It is possible to achieve a desired distribution of the suctioning force by designing a pattern of suction hole apertures in which the diameters and numbers of apertures are adjusted.

Desirably, suctioning force of the negative pressure suctioning device varies with respect to a breadthways direction of the recording medium in such a manner that the suctioning force in a central portion in the breadthways direction of the recording medium is greater than the suctioning force in an end portion in the breadthways direction.

By means of this mode, the suctioning properties of the recording medium are also improved.

Desirably, spray volume of the drying air flow spraying device varies with respect to a conveyance direction in which the recording medium is conveyed in such a manner that the spray volume onto a leading end portion of the recording medium is greater than the spray volume onto a trailing end portion of the recording medium.

According to this mode, the flow of the drying air flow in the direction following the conveyance direction of the recording medium becomes smooth, and the drying step is further stabilized. As a device for applying a gradient to the suctioning force, there is a mode where the aperture diameter of the spray holes and/or the number of spray holes is altered, for example. It is possible to achieve a desired distribution of the spray volume by designing a pattern of spray hole apertures in which the diameters and numbers of apertures are adjusted.

Desirably, spray volume of the drying air flow spraying device varies with respect to a breadthways direction of the recording medium in such a manner that the spray volume onto a central portion in the breadthways direction of the recording medium is greater than the spray volume onto an end portion in the breadthways direction of the recording medium.

According to this mode, the flow of the drying air flow in the breadthways direction becomes smooth, the drying step is further stabilized, and suction loss in the case of a recording medium of narrow width is also reduced.

Desirably, the conveyance device conveys a plurality of recording media continuously; and the negative pressure suctioning device simultaneously suctions at least a portion of a recording medium on a downstream side in a conveyance direction in which the recording medium is conveyed and at least a portion of a recording medium on an upstream side in the conveyance direction in such a manner that suction volume from a gap between these recording media by the negative pressure suctioning device is greater than spray volume of the drying air flow spraying device onto the recording medium on the downstream side.

According to this mode, it is possible to reduce stagnation of vapor when evaporation occurs at the surface of the recording medium during conveyance, and therefore drying can be promoted and soiling of the interior of the apparatus due to water vapor can be prevented.

Desirably, the inkjet recording apparatus comprises a restricting device capable of controlling a spraying range in a conveyance direction in which the recording medium is conveyed of the drying air flow created by the drying air flow spraying device.

According to this mode, it is possible to prevent unnecessary spraying of a drying air flow, and a suitable drying air flow can be applied to the necessary range. Therefore, the temperature rises quickly, and it is possible to control spraying in accordance with changes in the type of recording medium, the temperature and humidity, the liquid deposition volume, and the like, on the basis of input information relating to these changes, and therefore stable drying in accordance with the circumstances can be achieved.

Desirably, the inkjet recording apparatus comprises: a measurement device which measures at least one of a temperature and a moisture content of the recording medium conveyed by the conveyance device; and a control device which controls a spraying range of the drying air flow created by the drying air flow spraying device, according to measurement results of the measurement device.

According to this mode, it is possible to achieve drying having good response by controlling the spraying range in respect of variation in the thickness or liquid deposition volume, or the like, for each individual recording medium.

Desirably, the measurement device measures the at least one of the temperature and the moisture content of a same position in a leading end portion of the recording medium so as to calculate temporal change of the at least one of the temperature and the moisture content of that position in the leading end portion of the recording medium.

According to this mode, it is possible to achieve control having good response on the basis of the determination results of the measurement device.

Desirably, the conveyance device is a transfer drum having a gripper, and the drying air flow spraying device is disposed inside the transfer drum, and a restricting device composed of a cylindrical member having an aperture that restricts a spraying range in a conveyance direction in which the recording medium is conveyed of the drying air flow created by the drying air flow spraying device is disposed so as to be rotatable coaxially with the transfer drum.

According to this mode, good compatibility with a pressure drum system is obtained.

Desirably, the conveyance device is a transfer drum having a gripper, and the transfer drum has a plurality of apertures forming drying air flow blowing ports which function as the drying air flow spraying device, and a restricting device composed of a cylindrical member having an aperture that restricts a spraying range in a conveyance direction in which the recording medium is conveyed of the drying air flow created by the drying air flow spraying device is disposed inside the transfer drum so as to be rotatable coaxially with the transfer drum.

In this mode, similarly to the invention described above, good compatibility with a pressure drum system is obtained.

Another aspect of the present invention is directed to an inkjet recording method, comprising: a conveyance step of conveying a recording medium; a drying air flow spraying step of spraying a drying air flow onto the recording medium while the recording medium is conveyed in the conveyance step; a negative pressure suctioning step of suctioning a rear surface of the recording medium conveyed in the conveyance step while suctioning at least a portion of the drying air flow sprayed in the drying air flow spraying step; and an ink ejection step of ejecting ink to be deposited onto the recording medium, from an inkjet head.

According to this aspect of the present invention, it is possible to stabilize drying by rapidly discharging the drying air flow sprayed onto the recording medium, and furthermore by adopting a composition which suctions and attracts the rear surface of the recording medium, it is possible to suppress deformation, such as wrinkling or curl.

Desirably, the recording media conveyed in the conveyance step are cut sheets, and at least a portion of the drying air flow from a gap between recording media conveyed in the conveyance step is suctioned in the negative pressure suctioning step.

Desirably, the inkjet recording method comprises a spraying range control step of controlling a spraying range in a conveyance direction in which the recording medium is conveyed of the drying air flow sprayed in the drying air flow spraying step.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet recording apparatus, comprising:

a conveyance device which conveys a recording medium along a conveyance path;

a drying air flow spraying device which sprays a drying air flow onto the recording medium while the recording medium is conveyed in the conveyance path by the conveyance device;

a negative pressure suctioning pump;

a fixed conveyance guide which is fixed to a position in the conveyance path opposite the conveyance device and the drying air flow spraying device, and contacts with a rear surface of the recording medium while the recording medium is conveyed in the conveyance path by the conveyance device, the fixed conveyance guide having a negative pressure suctioning region in which a plurality of apertures connected to the negative pressure suctioning pump are arranged; and an inkjet head which ejects ink to be deposited on the recording medium, wherein, while the recording medium is conveyed in the conveyance path by the conveyance device, a portion of the drying air flow sprayed by the drying air flow spraying device is suctioned by the negative pressure suctioning pump through the apertures in the negative pressure suctioning region of the fixed conveyance guide to cause the fixed conveyance guide to suction the recording medium and to cause the recording medium to slide on the fixed conveyance guide with the rear surface thereof being in contact with the fixed conveyance guide.

2. The inkjet recording apparatus as defined in claim 1, wherein the recording medium includes cut sheets, and at least a portion of the drying air flow is suctioned from a gap between the cut sheets conveyed by the conveyance device.

3. The inkjet recording apparatus as defined in claim 1, wherein the drying air flow sprayed by the drying air flow spraying device is in a temperature range of 50° C. to 130° C.

4. The inkjet recording apparatus as defined in claim 1, further comprising a heat reutilization device which uses heat of air suctioned through the fixed conveyance guide to heat the drying air flow to be sprayed by the drying air flow spraying device.

5. The inkjet recording apparatus as defined in claim 1, further comprising a heating device which is formed with the fixed conveyance guide and heats the recording medium from the rear surface of the recording medium.

6. The inkjet recording apparatus as defined in claim 5, wherein the fixed conveyance guide includes a vibration device which vibrates the recording medium from the rear surface of the recording medium.

7. The inkjet recording apparatus as defined in claim 1, wherein a width of the negative pressure suctioning region of the fixed conveyance guide is greater than a width of the recording medium.

8. The inkjet recording apparatus as defined in claim 1, wherein suctioning force of the fixed conveyance guide varies with respect to a conveyance direction in which the recording medium is conveyed in such a manner that the suctioning force on an upstream side in the conveyance direction is greater than the suctioning force on a downstream side in the conveyance direction.

9. The inkjet recording apparatus as defined in claim 1, wherein suctioning force of the fixed conveyance guide varies with respect to a breadthways direction of the recording medium in such a manner that the suctioning force in a central portion in the breadthways direction of the recording medium is greater than the suctioning force in an end portion in the breadthways direction.

10. The inkjet recording apparatus as defined in claim 1, wherein spray volume of the drying air flow spraying device varies with respect to a conveyance direction in which the recording medium is conveyed in such a manner that the spray volume onto a leading end portion of the recording medium is greater than the spray volume onto a trailing end portion of the recording medium.

11. The inkjet recording apparatus as defined in claim 1, wherein spray volume of the drying air flow spraying device varies with respect to a breadthways direction of the recording medium in such a manner that the spray volume onto a central portion in the breadthways direction of the recording medium is greater than the spray volume onto an end portion in the breadthways direction of the recording medium.

12. The inkjet recording apparatus as defined in claim 1, wherein:

the conveyance device conveys a plurality of recording media continuously; and the fixed conveyance guide simultaneously suctions at least a portion of a first one of the recording media on a downstream side in a conveyance direction in which the recording media are conveyed and at least a portion of a second one of the recording media on an upstream side in the conveyance direction in such a manner that suction volume from a gap between the first and second ones of the recording media through the fixed conveyance guide is greater than spray volume of the drying air flow spraying device onto the first one the recording media on the downstream side.

13. The inkjet recording apparatus as defined in claim 12, further comprising:

a restricting device capable of controlling a spraying range in a conveyance direction in which the recording media are conveyed of the drying air flow created by the drying air flow spraying device, wherein before one of the recording media reaches the fixed conveyance guide, the spraying range is set in accordance with at least one of environmental temperature and humidity and a property of the one of the recording media including at least one of size, basis weight, density and thickness of the one of the recording media.

14. The inkjet recording apparatus as defined in claim 13, further comprising:

at least one of a permeation suppression agent deposition device and a treatment liquid deposition device, the permeation suppression agent deposition device depositing a permeation suppression agent on the recording media, the treatment liquid deposition device depositing a treatment liquid on the recording media;

a measurement device which measures at least one of a temperature and a moisture content of the one of the recording media in a state where the one of the recording media is in contact with the fixed conveyance guide and conveyed by the conveyance device, at least one of the permeation suppression agent, the treatment liquid and the ink having been deposited on the one of the recording media; and a control device which controls the restricting device to control the spraying range of the drying air flow created by the drying air flow spraying device, according to measurement results of the measurement device.

15. The inkjet recording apparatus as defined in claim 14, wherein the measurement device measures the at least one of the temperature and the moisture content of a same position in a leading end portion of the one of the recording media so as to calculate temporal change of the at least one of the temperature and the moisture content of that position in the leading end portion of the one of the recording media immediately after the one of the recording media comes into contact with the fixed conveyance guide.

16. The inkjet recording apparatus as defined in claim 15, wherein the position in the leading end portion of the one of the recording media is situated in a non-image portion on which at least one of the permeation suppression agent and the treatment liquid has been deposited and a check pattern has been printed by the inkjet head.

17. The inkjet recording apparatus as defined in claim 1, wherein:

the conveyance device is a transfer drum having a gripper, and the drying air flow spraying device is disposed inside the transfer drum, and a restricting device composed of a cylindrical member having an aperture that restricts a spraying range in a conveyance direction in which the recording medium is conveyed of the drying air flow created by the drying air flow spraying device is disposed so as to be rotatable coaxially with the transfer drum.

18. The inkjet recording apparatus as defined in claim 1, wherein the conveyance device is a transfer drum having a gripper, and the transfer drum has a plurality of apertures forming drying air flow blowing ports which function as the drying air flow spraying device, and a restricting device composed of a cylindrical member having an aperture that restricts a spraying range in a conveyance direction in which the recording medium is conveyed of the drying air flow created by the drying air flow spraying device is disposed inside the transfer drum so as to be rotatable coaxially with the transfer drum.

19. The inkjet recording apparatus as defined in claim 1, wherein the drying air flow spraying device and the conveyance guide are provided in a downstream side in a conveyance direction with respect to the inkjet head.

20. The inkjet recording apparatus as defined in claim 1, wherein:

a width of the negative pressure suctioning region of the fixed conveyance guide is greater than a width of the recording medium;

suctioning force of the fixed conveyance guide varies with respect to a conveyance direction in which the recording medium is conveyed in such a manner that the suctioning force on an upstream side in the conveyance direction is greater than the suctioning force on a downstream side in the conveyance direction; and the suctioning force of the fixed conveyance guide varies with respect to a breadthways direction of the recording medium in such a manner that the suctioning force in a central portion in the breadthways direction of the recording medium is greater than the suctioning force in an end portion in the breadthways direction.

21. An inkjet recording method, comprising:

a conveyance step of conveying a recording medium along a conveyance path by a conveyance device;

a drying air flow spraying step of spraying a drying air flow onto the recording medium by a drying air flow spraying device while the recording medium is conveyed in the conveyance path by the conveyance device, a fixed conveyance guide being fixed to a position in the conveyance path opposite the conveyance device and the drying air flow spraying device, the fixed conveyance guide contacting with a rear surface of the recording medium while the recording medium is conveyed in the conveyance path by the conveyance device, the fixed conveyance guide having a negative pressure suctioning region in which a plurality of apertures connected to a negative pressure suctioning pump are arranged;

a negative pressure suctioning step of, while the recording medium is conveyed in the conveyance path by the conveyance device, suctioning at least a portion of the drying air flow by the negative pressure suctioning pump through the apertures in the negative pressure suctioning region of the fixed conveyance guide to cause the fixed conveyance guide to suction the recording medium and to cause the recording medium to slide on the fixed conveyance guide with the rear surface thereof being in contact with the fixed conveyance guide; and an ink ejection step of ejecting ink to be deposited onto the recording medium, from an inkjet head.

22. The inkjet recording method as defined in claim 21, wherein the recording medium conveyed in the conveyance step includes cut sheets, and at least a portion of the drying air flow from a gap between the cut sheets conveyed in the conveyance path is suctioned in the negative pressure suctioning step.

23. The inkjet recording method as defined in claim 21, comprising a spraying range control step of controlling a spraying range in a conveyance direction in which the recording medium is conveyed of the drying air flow sprayed in the drying air flow spraying step.

* * * * *